US009184496B2

(12) United States Patent
Duwel et al.

(10) Patent No.: US 9,184,496 B2
(45) **Date of Patent: *Nov. 10, 2015**

(54) INDUCTORS HAVING FLUIDIC CONSTRUCTS THAT PERMIT RECONFIGURATION OF THE INDUCTORS

(75) Inventors: Amy E. Duwel, Cambridge, MA (US); Jason O. Fiering, Boston, MA (US); Douglas W. White, Lexington, MA (US); Brian R. Smith, Cambridge, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/252,695

(22) Filed: Oct. 4, 2011

(65) Prior Publication Data

US 2012/0068801 A1 Mar. 22, 2012

Related U.S. Application Data

(63) Continuation-in-part of application No. 12/832,587, filed on Jul. 8, 2010.

(60) Provisional application No. 61/389,628, filed on Oct. 4, 2010, provisional application No. 61/270,381, filed on Jul. 8, 2009.

(51) Int. Cl.

| | |
|---|---|
| ***H01Q 1/00*** | (2006.01) |
| ***H01Q 1/36*** | (2006.01) |
| ***H01Q 3/01*** | (2006.01) |
| ***H01Q 3/44*** | (2006.01) |

(52) U.S. Cl.

CPC ..... *H01Q 1/364* (2013.01); *H01Q 3/01* (2013.01); *H01Q 3/44* (2013.01)

(58) Field of Classification Search

USPC ..... 336/20; 343/720, 822, 866, 895, 343/700 MS

See application file for complete search history.

(56) References Cited

U.S. PATENT DOCUMENTS

| | | | | |
|---|---|---|---|---|
| 2,278,601 | A | 4/1942 | Werndl | |
| 5,429,000 | A | 7/1995 | Raj et al. | |
| 6,215,171 | B1 * | 4/2001 | Pape | 257/532 |
| 6,326,922 | B1 | 12/2001 | Hegendoerfer | |
| 6,859,189 | B1 | 2/2005 | Ramirez et al. | |

(Continued)

FOREIGN PATENT DOCUMENTS

| | | | |
|---|---|---|---|
| GB | 2435549 | A | 8/2007 |
| WO | WO-97/09926 | A1 | 3/1997 |

OTHER PUBLICATIONS

International Search Report and Written Opinion, PCT Application No. PCT/US2011/054749, mailing date Feb. 10, 2012, 13 pages.

(Continued)

*Primary Examiner* — Sue A Purvis
*Assistant Examiner* — Jae Kim
(74) *Attorney, Agent, or Firm* — Goodwin Procter LLP

(57) ABSTRACT

In various embodiments, an inductance of an inductor is tuned by adjusting a position of a conductor and/or a magnetic material with respect to a conducting wire of the inductor, thereby changing the electro-magnetic characteristics of the conducting wire. The conductor and/or magnetic material can be disposed in a microfluidic channel and can be moved within the microfluidic channel using a suitable actuator mechanism.

25 Claims, 17 Drawing Sheets

(56) References Cited

U.S. PATENT DOCUMENTS

| | | | | |
|---|---|---|---|---|
| 6,876,330 | B2 | 4/2005 | Alexeff et al. | |
| 6,906,680 | B2 | 6/2005 | Rawnick et al. | |
| 6,967,628 | B2 | 11/2005 | Rawnick et al. | |
| 7,262,734 | B2 | 8/2007 | Wood | |
| 7,336,238 | B2 | 2/2008 | Rawnick et al. | |
| 7,724,201 | B2 | 5/2010 | Nysen et al. | |
| 8,009,115 | B2 * | 8/2011 | Walton et al. | 343/757 |
| 2004/0252069 | A1 | 12/2004 | Rawnick et al. | |
| 2007/0023292 | A1 * | 2/2007 | Kim et al. | 204/643 |
| 2007/0115084 | A1 | 5/2007 | Beerling | |
| 2008/0198438 | A1 * | 8/2008 | Kuiper et al. | 359/280 |
| 2009/0322646 | A1 * | 12/2009 | Dreina et al. | 343/873 |
| 2010/0095762 | A1 * | 4/2010 | Despesse | 73/290 V |

OTHER PUBLICATIONS

Arcioni et al. "A Novel Low Reflection-Loss MEMS Reconfigurable Patch Antenna," Proceedings of the 10th European Conference on Wireless Technology, pp. 257-269, Oct. 2007.

Bhartia et al. "A Frequency Agile Microstrip Antenna," 1982 Antennas and Propagation Society International Symposium, vol. 20, pp. 304-307, May 1982.

Blondy et al. "A Wide Tuning Range MEMS Switched Patch Antenna," 2006 IEEE MTT-S International Microwave Symposium Digest, Jun. 2006, pp. 152-154.

Chauvel et al. "A micro-machined microwave antenna integrated with its electrostatic spatial scanning," Proceedings of the Tenth Annual International workshop on Micro Electro Mechanical systems, MEMS '97, pp. 84-89, Jan. 1997.

Chiao et al. "MEMS Reconfigurable Vee Antenna," Microwave Symposium Digest, 1999 IEEE MTT-S International, vol. 4, pp. 1515-1518, Jun. 1999.

Chiao et al. "MEMS RF devices for antenna applications," 2000 Asia-Pacific Microwave Conference, Dec. 3-6, 2000, pp. 895-898.

Erdil et al. "Frequency Tunable Microstrip Patch Antenna Using RF MEMS Technology," IEEE Transactions on Antennas and Propagation, vol. 55, No. 4, pp. 1193-1196, Apr. 2007.

Fang et al. "Wide-Angle-Scanning Reflectarray Antennas Actuated by MEMS," NASA Tech Briefs, NPO-45971, Mar. 2009, 1 page.

Fathelbab et al. "New Classes of Miniaturized Planar Marchand Baluns," IEEE Transactions on Microwave Theory and Techniques, vol. 53, No. 4, pp. 1211-1220, Apr. 2005.

Fayad et al. "Wideband saline-water antenna," Wideband and Multiband Antennas and Arrays, 2005. IEEE, Ref. No. 2005/11059, Sep. 7, 2005, pp. 197-201.

Gray et al. "Electronically Steerable Yagi-Uda Microstrip Patch Antenna Array," IEEE Transactions on Antennas and Propagation, vol. 46, No. 5, May 1998, pp. 605-608.

Holland et al. "Tunable coplanar patch antenna using varactor," Electronics Letters, Mar. 16, 2006, vol. 42, Issue 6, pp. 319-321.

Huff et al. "Integration of Packaged RF MEMS Switches With Radiation Pattern Reconfigurable Square Spiral Microstrip Antennas," IEEE Transactions on Antennas and Propagation. vol. 54, No. 2, pp. 464-469, Feb. 2006.

Jose et al. "Low voltage tunable capacitors for RF MEM filters and antenna applications," 2001 IEEE Antennas and Propagation Society International Symposium, vol. 3, pp. 670-673, Jul. 2001.

Jung et al. "Reconfigurable scan-beam single-arm spiral antenna integrated with RF-MEMS switches," IEEE Transactions on Antennas and Propagation, vol. 54, issue 2, part 1, pp. 455-463, Feb. 2006.

Kalialakis et al. "Analysis and experiment on harmonic radiation and frequency tuning of varactor-loaded microstrip antennas," IET Microwaves, Antennas & Propagation, vol. 1, No. 2, pp. 527-535, Apr. 2007.

Korosec et al. "Varactor-tuned microstrip-patch antenna with frequency and polarisation agility," Electronics Letters, vol. 42, Issue 18, Aug. 31, 2006, pp. 1015-1016.

Kosta "Mercury Patch Microwave Antenna," Proceedings of the International Conference on Smart Materials, Structures and Systems, Indian Institute of Science, Bangalore, India, pp. 701-706, Jul. 1999.

Kosta et al. "Liquid antenna systems," 2004 IEEE Antennas and Propagation Society International Symposium, vol. 3, Jun. 20-25, 2004, pp. 2392-2395.

Lake "Liquid Metal Antenna," [online]. Michael John Lake, 2005 [retrieved Jun. 2, 2010]. Retrieved from the Internet: <http://www.hamdomain.com/Im-antenna>, 5 pages.

Lee et al. "Surface-Tension-Driven Microactuation Based on Continuous Electrowetting," Journal of Microelectromechanical Systems, vol. 9, No. 2, Jun. 2000, pp. 171-180.

Mescher et al. "Surface Mount Microfluidic Flow Regulator on a Polymer Substrate," Proceedings of uTAS 2003: 7th International Conference on Micro Total Analysis Systems, uTAS '03, Squaw Valley, CA, pp. 947-950, Oct. 5-9, 2003.

Nishigaki et al. "Piezoelectric MEMS Variable Capacitor for a UHF Band Tunable Built-in Antenna," 2007 IEEE/MTT-S International Microwave Symposium, pp. 2079-2082, Jun. 2007.

Niyogi et al. "Variable Directional Coupler Employing Microfluidics," Proceedings of the 38th European Microwave Conference, Oct. 2008, pp. 207-210.

Paraschakis et al. "Ionic Liquid Antenna," IWAT 2005, IEEE International Workshop on Antenna Technology: Small Antennas and Novel Metamaterials, Mar. 7-9, 2005, pp. 552-554.

Peroulis et al. "Design of Reconfigurable slot Antennas," IEEE Transactions on Antennas and Propagation, vol. 53, No. 2, pp. 645-654, Feb. 2005.

Preston et al. "Base-Station Tracking in Mobile Communications Using a Switched Parasitic Antenna Array," IEEE Transactions on Antennas and Propagation, vol. 46, No. 6, pp. 841-844, Jun. 1998.

Sun et al. "Electronically tunable magnetic patch antennas with metal magnetic films," Electronics Letters, Apr. 12, 2007, vol. 43, Issue 8, pp. 434-436.

Wang et al. "A pattern-diversity antenna module for dual-band WLAN systems," 2004 60th IEEE Vehicular Technology Conference, vol. 1, pp. 211-215, Sep. 2004.

Baby et al. "Investigation of thermal and electrical conductivity of graphene based nanofluids," Journal of Applied Physics, vol. 108, 12, pp. 124308, Dec. 2010.

Dickey et al. "Eutectic Gallium—Indium (EGaIn): A Liquid Metal Alloy for the Formation of Stable Structures in Microchannels at Room Temperature," Adv. Funct. Mater., 2008, 18, pp. 1097-1104.

Hall et al. "Microstrip patch antenna with integrated adaptive tuning," Tenth International Conference on Antennas and Propagation, Conf. Publ. No. 436, vol. 1, 14-17, pp. 506-509, Apr. 1997.

Jin et al. "An L-band tunable microstrip antenna using multiple varactors," 2003 IEEE Antennas and Propagation Society International Symposium, 2003, pp. 524-527.

Kim et al. "A micromechanical switch with electrostatically driven liquid-metal droplet," Sensors and Actuators A, vol. 97-98, pp. 672-679, 2002.

Kosta et al. "A Liquid Patch Microwave Antenna," NACONECS-89, National Conference on Electronic Circuits and Systems Proceedings, UOR India, Nov. 2-4, 1989, pp. 43-45.

Kosta et al. "Strip-Slot-Air-Mercury Patch Microwave Antenna", Proceedings of the 2000 Antenna Applications Symposium, Sponsored by United States Airforce Sensors Directorate, University of Massachusetts and University of Illinois, Sep. 20-22, 2000, Illinois, USA. pp. 338-359.

Laser et al. "A review of micropumps," J Micromech Microeng 14:R35-R64, Apr. 2004.

Latorre et al. "Electrostatic actuation of microscale liquid-metal droplets," JMEMS 11, 4, pp. 302-308, Aug. 2002.

Nakano et al. "A patch antenna surrounded by parasitic Y elements for beam scanning," Antennas and Propagation Society International Symposium, IEEE, pp. 2317-2320, 2006.

Nguyen et al. "A simple PIFA-based tunable internal antenna for personal communication handsets," IEEE Antennas and Propagation Letters, vol. 7, pp. 130-133, 2008.

Ni et al. "Electrochemically actuated mercury pump for fluid flow and delivery," Anal Chem 73, pp. 103-110, Jan. 2001.

(56) References Cited

OTHER PUBLICATIONS

Oh et al. "A PIFA-Type Varactor—Tunable Slim Antenna with a PIL Patch Feed for Multiband Applications," IEEE Antennas & Wireless Prop. Letters, vol. 6, pp. 103-105, 2007.
Schall et al. "Structural Rearrangements That Govern Flow in Colloidal Glasses", Science, vol. 317, pp. 1895-1899, Dec. 2007.
Simon et al. "A liquid-filled microrelay with a moving mercury microdrop," Journal of Microelectromechanical Systems, vol. 6, 3, pp. 208-216, Sep. 1997.
Thiel "Switched parasitic antennas and controlled reactance parasitic antennas: A systems comparison," Antennas and Propagation Society International Symposium, IEEE, vol. 3, pp. 3211-3214, 2004.
White et al. "Single- and Dual-Polarized Tunable Slot-Ring Antennas," IEEE Transactions on Antennas and Propagation. vol. 57, 1, pp. 19-26, Jan. 2009.
Yang et al. "Electronically tunable miniaturized antennas on magnetoelectric substrates with enhanced performance," IEEE Transactions on Magnetics., vol. 44, No. 11, pp. 3091-3094 Nov. 2008.
Yang et al. "Planar circular loop antennas with self-biased magnetic film loading," Electronics Letters, vol. 44, No. 5, 332, Feb. 2008, 2 pages.
Gmati et al. "Wide-range RF MEMS variable inductor using micro pump actuator" Signals, Circuits and Systems. SCS 2008. 2nd International Conference on IEEE. pp. 1-4, Fig 1-3, 2008.

* cited by examiner

INDUCTORS HAVING FLUIDIC CONSTRUCTS THAT PERMIT RECONFIGURATION OF THE INDUCTORS

CROSS-REFERENCE TO RELATED APPLICATIONS

This application is a continuation-in-part of, claims priority to and the benefit of, and incorporates herein by reference in its entirety U.S. patent application Ser. No. 12/832,587, which was filed on Jul. 8, 2010 and which claimed priority to and the benefit of U.S. Provisional Patent Application No. 61/270,381, filed on Jul. 8, 2009 and also incorporated herein by reference in its entirety. This application also claims priority to and the benefit of, and incorporates herein by reference in its entirety, U.S. Provisional Patent Application No. 61/389,628, which was filed on Oct. 4, 2010.

FIELD OF THE INVENTION

The technology disclosed herein relates generally to electronic devices incorporating fluidic conductors and/or floated solid conductors.

BACKGROUND

Electronic systems and components, particularly those that operate in radio-frequency (RF) ranges, are sensitive to the physical size of the constituent components and interconnects. Thus, changes in the geometry or layout of a transmission line, capacitor, antenna, tuning stub, filter, or other components will affect the performance and/or operating frequency of the RF system. These geometrical features are typically viewed as permanent characteristics of a system once the design, fabrication, and assembly is completed. In order to optimize the system after construction, engineers often tune components by physically removing metal from components (a typical approach for tuning planar antennas), adding bond wires, turning tuning screws, or changing lengths of other adjustable interconnections. These methods are not only time-intensive, but require manual implementation each time a change is desired. If the RF electronic system is installed in an environment that influences its performance, then additional tuning after installation is often required. Conventional methods for physically adjusting the topology or layout of a system are not dynamic and do not enable dynamic adjustments to the system.

In order to allow for dynamic tuning (as opposed to geometric reconfiguration), RF engineers often use tunable capacitors and/or electrical switches. Such devices allow engineers to adjust the system for environmental changes and also give a new capability to provide real-time steering, tuning, band-switching, and other changes to the RF system. However, these lumped-element individual components introduce performance drawbacks including electrical loss, and also require power to hold a given configuration.

In the specific case of RF antennas, due to the limitations of conventional technologies, today's personal and miniature communications systems generally over-specify the physical size, spectral bandwidth, and/or aerial coverage of the antenna. A great deal of effort in the microwave community is being dedicated to antenna miniaturization, but generally only towards minimizing the antenna footprint. Typically, the thickness of the antenna substrate remains unchanged, which is problematic for ultra-miniature applications. The research community has not in general taken on the challenge of reducing this dimension since doing so tends to reduce the antenna bandwidth.

In general, antenna bandwidth is over-specified so that even if the antenna is detuned, it will still capture the desired signal band. The signal bandwidth for the commercial CA-code GPS signal is only about 2 MHz wide but typical GPS patch antennas have a bandwidth of 20 MHz or more to accommodate temperature variations and proximity effects. The bandwidth of a patch antenna is roughly proportional to the substrate thickness, so that if the antenna can be kept on frequency with an active tuning system, the bandwidth and substrate thickness may be reduced by an order of magnitude. Standard approaches to antenna tuning (like those described above), however, generally degrade the antenna's performance. This is because antennas that are tuned via adjustable loading must typically be designed for operation confined to some portion of the tunable band, thereby degrading efficiency. The ability to tune the actual antenna geometry is not typically pursued.

Miniature antennas are, generally, also not adaptable to spatial variations in the external signal. The spatial signal profile and its polarization can vary dramatically due to "multipath" propagation and other environmental effects. Directionally specific, steerable antennas have long been used in complex systems where power and space are available for both the antenna and associated components to operate it. Both analog and digital approaches (e.g., beamforming) may be used, even in strapped-down cellular base stations. However, steerable antennas have generally not been leveraged into miniature communications systems due to the complexity of mechanical and electrical support.

As a result, communications systems generally transmit orders of magnitude more power and require more spectrum usage than they would if it were possible to stay within the signal bandwidth and transmit to the precise location needed.

A common method of adjusting narrow-bandwidth patch antennas is to add solid tuning "fingers" to the edges of the patch. The fingers are usually trimmed by hand with a knife. The size and number of fingers may be selected to allow for very fine control of the patch frequency and input impedance even with relatively coarse adjustments to the length of the fingers. Again, however, such tuning fingers are themselves not dynamically adjustable, and provision and/or manual trimming of such fingers a multitude of times is unwieldy and impractical.

The use of varactor diodes to tune a microstrip patch antenna has also been explored. Numerous researchers have expanded on this approach with multiple-diode configurations, and other antenna geometries. However, although well-suited to receive applications, varactor diodes are highly nonlinear and can generate significant unwanted harmonics even at moderate transmit power levels. More recently, MEMS varactors have also been applied in antenna tuning applications. In order to achieve larger frequency shifts for band-switching applications, changes in polarization or antenna pattern, PIN diodes, FETs, and MEMS switches have been used. However, these and other techniques typically produce discrete steps in performance, not continuous, analog tuning, and typically require applied power to maintain a specific configuration.

In many RF and power systems, tunable circuit elements are valuable for optimizing system performance in a dynamic environment (such as matching in response to environmental pulling). Tunable circuit elements may also be beneficial to systems having dynamically changing requirements (such as systems having changing power levels) or to reconfigurable systems (such as those that allow communication channels to be changed). Tunable circuit elements may even facilitate optimizing performance after installation. Even though RF and power systems typically include both inductors and capacitors, at present tunable inductors are not generally available. As such, many existing systems rely almost entirely on tunable capacitors and/or switches, or tunable guided-wave structures such as tunable stubs implemented with switching elements. This generally limits the topologies available for tuning a system. In addition, by only being able to tune a capacitance and not an inductance, the ability to optimize a system for all performance parameters simultaneously (such as frequency of operation and impedance) is often limited.

SUMMARY

In accordance with various embodiments of the invention, microfluidic technology, utilizing one or more of conductive liquids, floated conductive solids, or floated magnetic solids, is used to form a variety of reconfigurable and/or steerable electronic components such as antennas and tunable inductors. Furthermore, in some embodiments the technology is utilized to form "overlay" structures that impart reconfigurability to existing components. Embodiments of the invention advantageously require no applied power to maintain a selected configuration.

For many RF elements, including antennas, the shape and/or orientation of the metallic structure thereof determines important performance properties. The microfluidic technology described herein offers a powerful ability to tune an antenna during operation so that the bandwidth and substrate thickness specifications may be relaxed. The ability to reconfigure RF components enables reconfigurable communications systems. Embodiments of the invention described herein are applicable to a range of reconfigurable component designs, such as antennas (e.g., GPS antennas and patch antennas), and to products (both consumer-based and military) in the growing wireless communications market.

The inductance of an inductor can be adjusted by altering the electro-magnetic properties of the inductor's conducting wire (e.g., the inductor's coil). The electro-magnetic properties of the conducting wire can be dynamically changed by, e.g., shorting one or more parts or windings of the conducting wire and/or by changing a location of a magnetic material with respect to the conducting wire. In various embodiments of the invention, this is achieved by moving a conductor and/or a magnetic material suspended within a microfluidic channel with respect to the conducting wire. In the case of three dimensional inductors, the location of a magnetic core or magnetic material with respect to the inductor's conducting wire determines, in part, the inductance of the inductor. By moving the magnetic core or magnetic material with respect to the conducting wire using the microfluidic technology described herein, an inductor being used in RF or power circuitry can be tuned as an alternative or in addition to tuning the capacitors or other components of the RF/power circuitry.

In one aspect, embodiments of the invention feature a reconfigurable electronic component including or consisting essentially of a substantially planar conducting surface, a fluidic channel, a conductor disposed within the fluidic channel, and an actuating mechanism for displacing the conductor within the fluidic channel. The fluidic channel defines a path that at least partially overlies the conducting surface, and a portion of the path extends from and does not overlie the conducting surface. The electronic component may be an antenna, a phase shifter, a balun, a variable capacitor, a tunable inductor, a tunable stub, a tunable transmission line, a tunable frequency-selective surface, a tunable metamaterial, a tunable matching network, a moveable feed structure (e.g., for an antenna), and/or a reconfigurable switch, to name a few examples.

Embodiments of the invention may feature one or more of the following, in any of a variety of combinations. The path may only partially overlie the conducting surface. The conducting surface may be substantially continuous. The fluidic channel may be closed. The actuating mechanism may include or consist essentially of a second conductor disposed within a portion of the fluidic channel not disposed over the conducting surface, and may further include a plurality of electrodes for displacing the second conductor within the fluidic channel. The conducting surface may be at least a portion of an antenna, e.g., a patch antenna. An insulator, e.g., a fluidic or solid insulator, may be disposed within the fluidic channel. The insulator and the conductor may be substantially immiscible fluids. The fluidic channel and the actuating mechanism may be disposed within a cover layer that is physically separable from the conducting surface. A ground plane may be disposed beneath the conducting surface. The conductor may be a conductive fluid. The fluidic channel may contain a fluid, and the conductor may include or consist essentially of a conductive solid floating in the fluid. The fluidic channel may be elongated and/or the path may be tortuous.

In another aspect, embodiments of the invention feature a cover layer for imparting reconfigurability to an electronic component that includes a conducting surface. The cover layer includes or consists essentially of a substrate, a fluidic channel associated with (e.g., disposed over, on, or within) the substrate, a conductor disposed within the fluidic channel, and an actuating mechanism for displacing the conductor within the fluidic channel. The fluidic channel is disposable over the conducting surface so as to at least partially overlie, and to extend from, the conducting surface.

Embodiments of the invention may feature one or more of the following, in any of a variety of combinations. The fluidic channel may only partially overlie the conducting surface. An insulator may be disposed within the fluidic channel. The insulator and the conductor may be substantially immiscible fluids. The actuating mechanism may include or consist essentially of a second conductor disposed within a portion of the fluidic channel not overlapping the conducting surface, and may further include a plurality of electrodes for displacing the second conductor within the fluidic channel. The conductor may be a conductive fluid. The fluidic channel may contain a fluid, and the conductor may include or consist essentially of a conductive solid floating in the fluid.

In yet another aspect, embodiments of the invention feature a steerable antenna including or consisting essentially of a fluidic channel, a moveable driven element, and an actuating mechanism. The driven element comprises or consists essentially of a conductor and is disposed within the fluidic channel. The actuating mechanism displaces the driven element within the fluidic channel, thereby facilitating the redirection of a beam radiated from the antenna.

Embodiments of the invention may feature one or more of the following, in any of a variety of combinations. The fluidic channel may be disposed between a reflector and a director, and the beam may radiate in a direction substantially collinear with the reflector, driven element, and director. The reflector and the director may be disposed within additional discrete fluidic channels, and additional actuating mechanisms may displace the reflector and the director within their respective fluidic channels. The reflector and the director may be disposed on a substrate, and the fluidic channel and the actuating mechanism may be disposed on or within a cover layer that is physically separable from the substrate.

In a further aspect, embodiments of the invention feature a reconfigurable electronic component including or consisting essentially of a solid radiating structure floating in a fluidic channel, a conductor disposed beneath the radiating structure, a fluidic interconnect providing electrical and/or capacitive coupling between the radiating structure and the conductor, and an actuating mechanism for displacing (e.g., translating and/or rotating) the radiating structure within the fluidic channel.

In yet a further aspect, embodiments of the invention feature a radiating structure including or consisting essentially of a first channel containing a fluidic balun therein, a second channel containing a fluidic radiating antenna therein, and an actuating mechanism for displacing the fluidic balun and fluidic radiating antenna substantially in unison.

In still another aspect, embodiments of the invention feature a reconfigurable inductor that includes a conducting wire and a fluidic channel. The fluidic channel defines a path that overlies at least a portion of the conducting wire. A conductor is disposed within the fluidic channel, and the inductor includes an actuating mechanism for displacing the conductor within the fluidic channel. The displacement of the conductor can change electrical properties of the conducting wire, or may change a magnetic field associated with the conducting wire, thereby changing the inductance of the inductor.

In some embodiments, a portion of the path extends from and does not overlie the conducting wire, while in other embodiments the path only partially overlies the conducting wire. In some embodiments, the fluidic channel is closed. The actuating mechanism may include a second conductor disposed within a portion of the fluidic channel that is not disposed over the conducting wire. The actuating mechanism may also include two or more electrodes for displacing the second conductor within the fluidic channel, thereby causing displacement of the first conductor.

In some embodiments, the conductor is magnetic, and the actuating mechanism includes a magnet disposed proximate at least a portion of the conducting wire. In some embodiments, the conductor electrically connects several portions of the conducting wire over which it is disposed. The inductor may also include an insulator (e.g., a fluidic insulator) disposed within the fluidic channel. The insulator and the conductor may be substantially immiscible fluids.

In some embodiments, the fluidic channel and the actuating mechanism are disposed within a cover layer, e.g., a glass tube that is physically separable from the conducting wire. The conductor may be a conductive fluid. Alternatively, the fluidic channel may contain a fluid and the conductor may include or consist essentially of a conductive solid floating in the fluid. Displacing the conductor in the fluidic channel can change an inductance of the inductor by a value ranging from approximately 1 nH to approximately 10 nH.

In an additional aspect, embodiments of the invention feature a reconfigurable inductor that includes a fluidic channel, a conductive wire wound around at least a portion of the fluidic channel, and an actuating mechanism. The fluidic channel contains a magnetic material, which may be displaced therewithin by the actuating mechanism.

In some embodiments, the fluidic channel of the inductor is closed. The actuating mechanism may include a conductor disposed within a portion of the fluidic channel around which the conducting wire is not wound. The actuating mechanism may also include two or more electrodes for displacing the conductor within the fluidic channel. In some embodiments, the actuating mechanism includes a magnet disposed proximate at least a portion of the fluidic channel.

The inductor may also include an insulator (e.g., a fluidic insulator) disposed within the fluidic channel. The insulator and the magnetic material may be substantially immiscible fluids. In some embodiments, the magnetic material is a bulk ferrite core. Alternatively, the fluidic channel may contain a fluid and the magnetic material contained within the fluidic channel may be a high-permeability material floating in the fluid. Displacing the magnetic material in the fluidic channel can change an inductance of the inductor by a value ranging from approximately 1 nH to approximately 10 nH.

In yet another aspect, embodiments of the invention feature a reconfigurable inductor that includes a conducting wire and a fluidic channel. The fluidic channel defines a path that overlies at least a portion of the conducting wire. A magnetic material is disposed within the fluidic channel, and the inductor includes an actuating mechanism for displacing the magnetic material within the fluidic channel. The displacement of the magnetic material can change electrical properties of the conducting wire, or may change a magnetic field associated with the conducting wire, thereby changing the inductance of the inductor.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. As used herein, the term "substantially" means±10%, and, in some embodiments, ±5%. The term "consists essentially of" means excluding other materials that contribute to function, unless otherwise defined herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

In various embodiments of the present invention, microfluidic systems integrate fluidic or solid conductors with electronic components (such as antennas, phase shifters, baluns, variable capacitors, tunable inductors, tunable stubs, tunable transmission lines, tunable frequency-selective surfaces, tunable metamaterials, tunable matching networks, moveable feed structures (e.g., for antennas), and/or reconfigurable switches, etc.) to make such components reconfigurable. Such designs may be employed in ultra-small RF systems that may be tunable, ultra-wide band, or multi-band. While many of the components in accordance with embodiments of the invention are generally planar, a planar geometry is not a requirement of various embodiments. In particular, antenna frequency, bandwidth, and/or beam shape may be determined by the physical layout of the antenna together with the physical location of the feed network. The ability to tune the physical geometry in real-time enables real-time control over these key parameters.

Figure 1A:
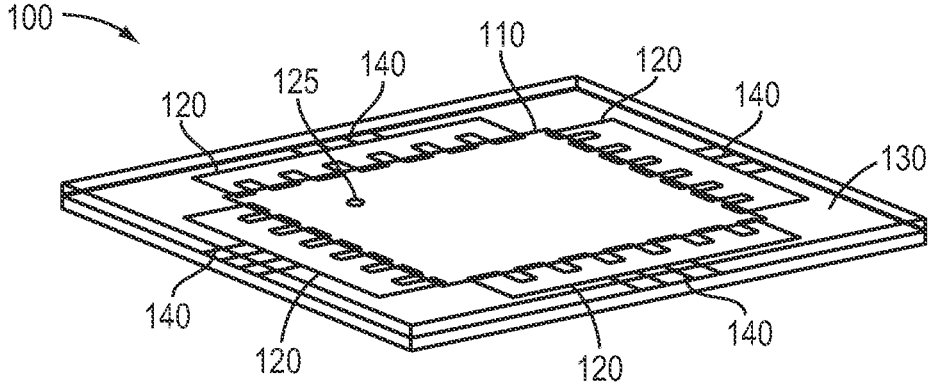
FIGS. 1A and 1B schematically depict a perspective view and an enlarged partial perspective view, respectively, of a reconfigurable electronic component in accordance with embodiments of the invention.
Figure 1B:
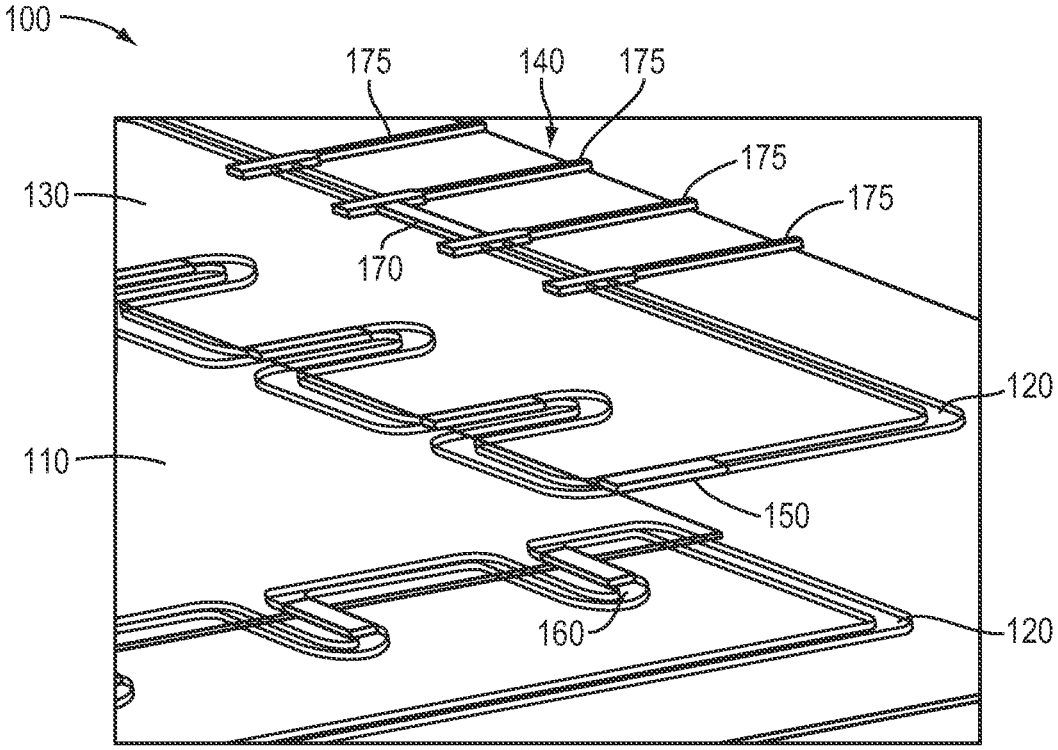
Figure 1C:
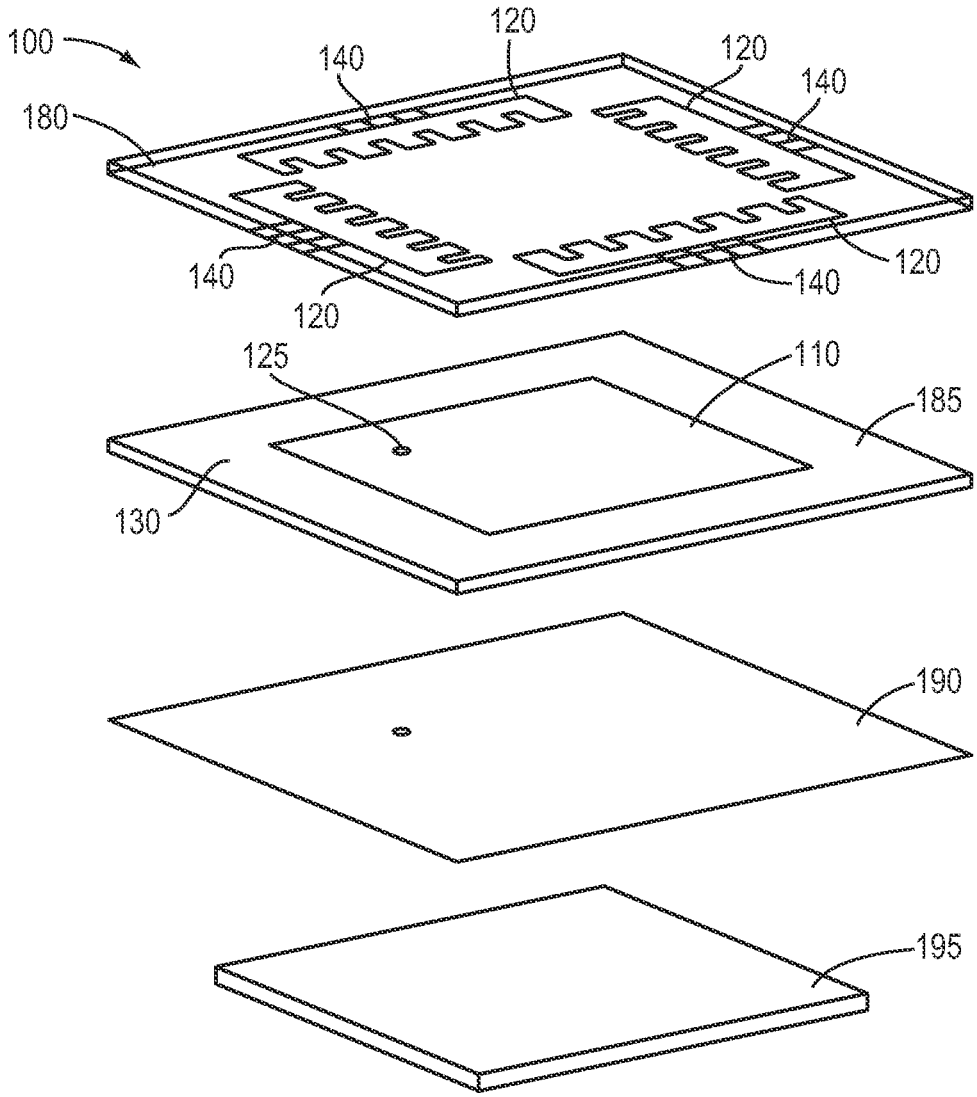
FIG. 1C depicts an exploded perspective view of the component of FIGS. 1A and 1B.

FIGS. 1A-1C depict one exemplary embodiment that utilizes a conductor to change the geometry of an electronic component, in this case a tunable patch antenna, via movement along microfluidic channels (which may be present in an active cover layer, as described below). Specifically, a reconfigurable component 100 includes a conducting surface 110 and one or more microfluidic channels 120 overlying conducting surface 110. Component 100 may also include a feed point 125, as understood by those of skill in the art of, e.g., antenna design. Conducting surface 110 may include or consist essentially of a solid material such as a metal, and is generally substantially planar and substantially continuous, rather than broken up into discrete sub-surfaces or "pixels." Moreover, conducting surface 110 may be substantially polygonal (e.g., rectangular or square) or circular in shape, and may be substantially free of small protrusions (like the above-described "fingers") at the edges thereof, other than those formed or enabled by the microfluidic channels 120. Typically, conducting surface 110 is not a ground plane, but rather may be a radiating element disposed over a ground plane.

In some embodiments, each microfluidic channel 120 is a generally elongated tubular structure whose longitudinal length typically greatly exceeds its width or diameter (e.g., having a ratio of length to width or diameter of greater than approximately 100:1, or even greater than approximately 1000:1), and any fluid therein generally does not directly contact conducting surface 110. However, microfluidic channels 120 need not be severely elongated (and may be, e.g., substantially rectangular or even square in shape) and may have sizes and ratios of length to width similar to those of an underlying electronic component or conducting surface. In various embodiments, the dimensions (e.g., length and width or diameter) of each microfluidic channel 120 generally depend upon the dimensions of an underlying electronic component or conducting surface 110. Such dimensions may be as large as one or more inches, and may be as small as 250 μm, or even smaller.

The inner surfaces of a microfluidic channel 120 may be substantially hydrophobic. Each microfluidic channel 120 may include portions disposed directly over conducting surface 110 (i.e., without metallic or electrical structures such as electrodes therebetween) and portions extending therefrom, as shown in FIG. 1B. Generally, the microfluidic channels 120 are confined to peripheral regions of conducting surface 110, rather than extending over the entire surface of conducting surface 110 or even a center portion thereof. Likewise, microfluidic channels 120 (or any fluid therein) typically do not electrically connect discrete portions of component 100 (although they could in some embodiments); rather, they are utilized to reconfigure the size, shape, and/or electrical properties of conducting surface 110. Hence, in typical embodiments, component 100 would function properly, but lack reconfigurability, without the presence of microfluidic channels 120 and/or fluid therein.

Each microfluidic channel 120 may also extend from the above-described portions to a peripheral region 130 of component 100 spaced apart from conducting surface 110, and connect to an actuating mechanism 140. Disposed within each microfluidic channel 120 are one or more conductors 150 that are positionable within the microfluidic channel 120 to alter the properties, e.g., frequency and/or bandwidth, of component 100. In various embodiments, conductors 150 are fluidic conductors, e.g., discrete portions of a conductive liquid. For example, conductors 150 may include or consist essentially of mercury, alloys including gallium, indium, and/or tin, and/or a colloid of metal particles suspended in a liquid (e.g., silver or copper particles suspended in a perfluorinated oil). In other embodiments, conductors 150 are solid, e.g., metal, and may be floated in a liquid contained within microfluidic channel 120. As utilized herein, references to "floated" or "floating" solids do not necessarily imply that the solid has a lower density than the liquid in which it is disposed, or that the solid is generally disposed at or near an upper surface of the liquid. Likewise, references to solids being "immersed" within a liquid do not necessarily imply that the liquid is disposed on all sides of the solid, only that the solid is generally disposed within the same volume as the liquid and is generally moveable therewithin.

Solid conductors 150 may even include a non-metallic or non-conductive material, e.g., a polymeric material, coated with a layer of metal to impart conductivity thereto. As pictured in FIG. 1B, each discrete conductor 150 may be a discrete solid or may be multiple smaller solids "chained" together in order to facilitate movement of conductor 150 within microfluidic channel 120. Conductor 150 may even be magnetic (e.g., a ferrofluid) in some embodiments. Conductors 150 may be separated from each other within microfluidic channel 120 by one or more insulators 160 (depicted in FIG. 1B as transparent for clarity). Like conductors 150, insulators 160 may be fluidic (e.g., a liquid dielectric) and/or solid. Both conductors 150 and insulators 160 may be liquids immiscible in each other. In some embodiments, microfluidic channel 120 contains only one or more insulators 160 (and no conductors 150) that may have, e.g., one or more dielectric constants. Such insulators 160 may be utilized in a manner similar to methods of utilizing conductors 150 to reconfigure electronic components described herein. For example, an insulator 160 having a particular dielectric constant extended from conducting surface 110 may be used to reconfigure one or more properties of a component 100, e.g., an antenna.

In some embodiments, microfluidic channel 120 is "closed," i.e., is not connected to a reservoir or other source or sink for fluid, and the total amount of fluid (and amount of conductors 150 and/or insulators 160) therewithin remains substantially constant during operation of component 100. Thus, reconfiguration of component 100 does not require the emptying and filling of discrete "cavities."

There are several advantages to a closed-channel system. For example, the use of a pressure release valve is generally unnecessary, thereby minimizing the possibility of contamination and/or leakage. Moreover, because a fluidic pump need not work against a pressure, a lower power design is enabled. The displacement-based concept is inherently stable and does not require applied power or valves to hold a given position. Optionally, however, a normally closed valve may be employed to add stability against inertia.

The configuration of component 100 via the positioning of conductors 150 (and/or insulators 160) within microfluidic channel 120 is typically controlled by actuating mechanism 140. Actuating mechanism 140 is preferably removed from conducting surface 110 (so, e.g., any electrodes associated with actuating mechanism 140 do not interfere with the operation of component 100). In a preferred embodiment, microfluidic channel 120 is closed (and substantially filled with liquid), and actuating mechanism 140 includes or consists essentially of an actuating conductor 170 and a plurality of electrodes 175. During operation, the actuating conductor 170 is repositioned, e.g., between various pairs of electrodes 175, by, e.g., electrowetting. Specifically, by proper selection of a voltage placed across actuating conductor 170 via electrodes 175, the actuating conductor 170 is repositioned within microfluidic channel 120. Since microfluidic channel 120 is typically substantially filled with liquid, the movement of actuating conductor 170 results in the corresponding movement of the other conductor(s) 150 within microfluidic channel 120. (That is, voltage is not applied to conductors 150 directly by electrodes 175; rather, the voltage applied to actuating conductor 170 results in movement of conductors 150.) As shown in FIG. 1B, in this manner, the conductors 150 may be retracted to reside entirely above conducting surface 110, or they may be extended an arbitrary length beyond an edge of conducting surface 110, thereby reconfiguring component 100. In this manner, one or more properties of component 100 may be "analog" tuned across a continuous range of values, rather than discretely stepped among a series of discrete, separated values (e.g., as if conductors 150 were filling discrete "pixels" or assuming one of only a few predetermined positions when actuated). Control over the placement of conductors 150 may be facilitated by the use of many, closely spaced electrodes 175, and/or utilization of a microfluidic channel 120 that has different cross-sectional areas in different regions. For example, actuating conductor 170 may be disposed within a portion of microfluidic channel 120 with a smaller cross-sectional area than that where one or more conductors 150 reside; thus, movement of actuator conductor 170 results in a correspondingly smaller movement of the other conductors 150, enabling fine control thereof.

In other embodiments of the invention, actuating mechanism 140 includes or consists essentially of a pump connected to microfluidic channel 120, which controls motion of conductors 150 via application of positive or negative hydraulic pressure thereto. In yet other embodiments, when conductors 150 are magnetic, actuating mechanism 140 may include or consist essentially of one or more positionable magnets disposed beneath conductors 150. Magnets may also be utilized (as shown in, e.g., FIGS. 4A and 4B) as "clamps" that hold a solid conductor 150 in a desired position after it has been actuated by any of the above-described actuating mechanisms 140. Such magnets may be repositionable or may be fixed at desired locations beneath conducting surface 110 and microfluidic channels 120. Conductors 150 may even be capacitively coupled to (rather than directly electrically connected to) conducting surface 110 in some embodiments.

As shown in FIGS. 1A-1C, various embodiments of the invention feature a separate closed microfluidic channel 120 with a dedicated actuating mechanism 140 for each side of conducting surface 110 (and hence component 100), although it is not a requirement that each side of conducting surface 110 have an associated microfluidic channel 120. In other embodiments, a single microfluidic channel 120 with a single actuating mechanism 140 extends along one or more, or even all sides of conducting surface 110. In still other embodiments, particularly for large conducting surfaces 110, multiple closed microfluidic channels 120 (and actuating mechanisms 140) are disposed along each side of conducting surface 110.

In some embodiments, the microfluidic elements, e.g., microfluidic channel 120 with conductors 150 and insulators 160 therein, as well as actuating mechanism 140, are integrated with conducting surface 110 during fabrication of component 100 and are permanent portions thereof. In other embodiments, the microfluidic elements are disposed within a discrete conforming, generally two-dimensional surface or layer disposed above conducting surface 110 and affixed to component 100. For example, as shown in the exploded view of FIG. 1C, a functional cover layer 180 containing the microfluidic elements may be designed to enable reconfigurability of an electronic component 100 inherently lacking such capability. Microfluidic channel(s) 120 and conductor(s) 150 may be sized and shaped based on the size and shape of a conducting surface of such a component 100, as well as on the amount of tunability desired for specific properties of the component 100. Cover layer 180 may be permanently affixed to electronic component 100 (e.g., with a permanent adhesive), or may be temporarily affixed thereto (e.g., with a temporary adhesive or a reversible attachment mechanism) and removed when the reconfigurability functionality is not needed or not desired. Multiple layers of microfluidic functionality may even be utilized on a single electronic component 100 via the use of multiple stacked cover layers 180. Cover layer 180 preferably includes or consists essentially of one or more dielectric materials, e.g., polymeric materials (e.g., KAPTON polyimide film supplied by E.I. du Pont de Nemours Co., Wilmington, Del.), glasses, or ceramics. In various embodiments, the thickness of cover layer 180 is less than approximately 1 mm, less than approximately 500 μm, or even less than approximately 25 μm.

As shown in FIG. 1C, electronic component 100 may include other layers in addition to cover layer 180 and layer 185 that includes conducting surface 110. For example, a ground plane 190 (i.e., a conducting plane typically at least slightly larger in extent than conducting surface 110) may be incorporated below conducting surface 110, as is generally known in the art. Furthermore, electronic component 100 may include a substrate layer 195, e.g., a generally rigid layer for mechanical support and on or through which electrical contact may be made to electronic component 100 via external circuits or interconnects.

Figure 1D:
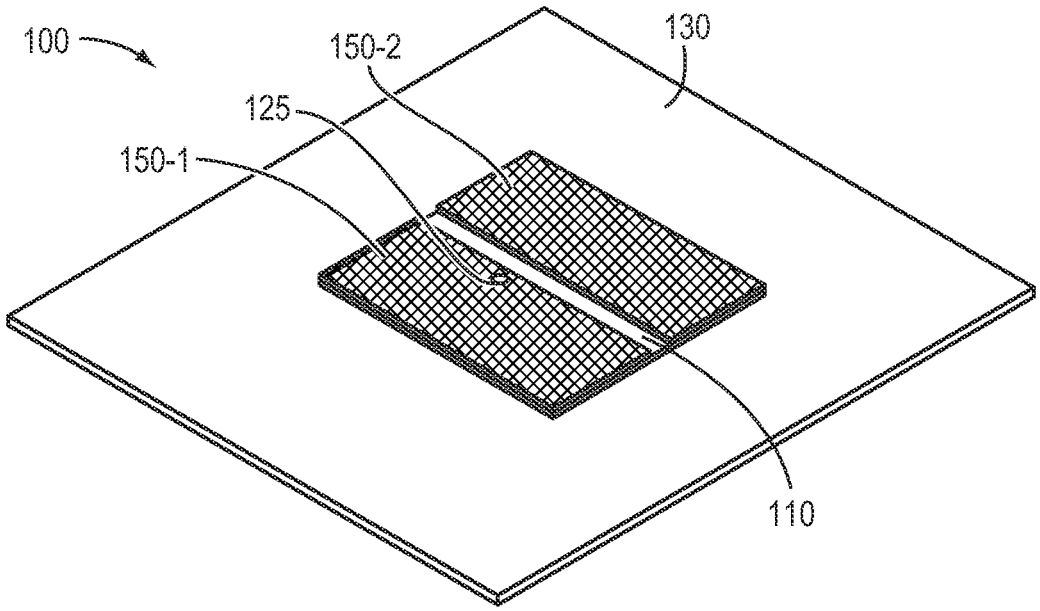
FIGS. 1D, 1E, and 1F schematically depict perspective views of different configurations of a reconfigurable electronic component in accordance with various embodiments of the invention.
Figure 1E:
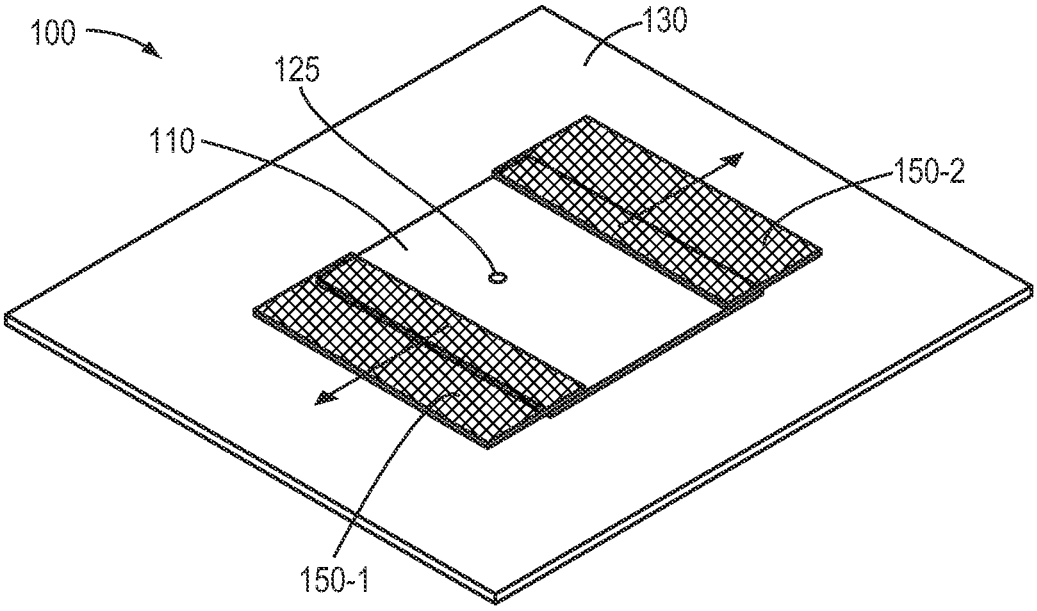
Figure 1F:
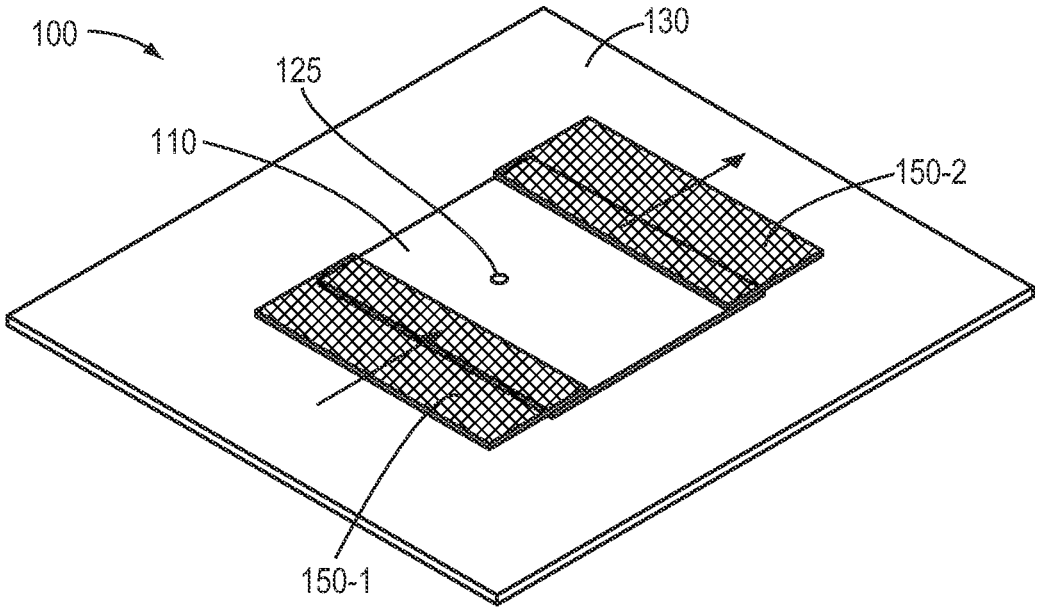

As described above, embodiments of the invention feature floating solid conductors to reconfigure various properties of electronic components such as antennas. FIGS. 1D-1F depict a component 100 (specifically a patch antenna) having a conducting surface 110 that may be reconfigured via the positioning of floating solid conductors 150-1, 150-2. (For clarity, associated components such as microfluidic channels 120 and actuating mechanism 140 are not shown in FIGS. 1D-1F.) As shown in FIG. 1D, the conductors 150 may be disposed directly over conducting surface 110 when no reconfiguration of component 100 is desired. As depicted in FIGS. 1D-1F, conductors 150 may have any number of small openings therein, and may even have a "cross-hatched" appearance. In other embodiments, conductors 150 are continuous thin solid sheets. The thickness of conductors 150 may be substantially equal to the skin depth of conducting surface 110 (e.g., less than approximately 10 μm), and microfluidic channels 120, in which conductors 150 are disposed, may have a vertical height only slightly larger (e.g., between approximately 20 μm and approximately 100 μm) than the conductor thickness.

As shown in FIG. 1E, the frequency of component 100 may be changed (here, decreased) by the substantially symmetric outward movement of conductors 150-1, 150-2 such that the conductors increase the effective area of conducting surface 110. Similarly, as shown in FIG. 1F, the impedance of component 100 may be tuned by moving conductors 150-1, 150-2 substantially independently and/or in opposite directions, thereby effectively changing the location of feed point 125. A suitable actuating mechanism 140 may utilize a series of electrodes 175, as described above, to electrokinetically pump conductors 150 into their desired positions. Once positioned, conductors 150 may be "clamped" (i.e., capacitively coupled) to conducting surface 110 via a magnet disposed beneath conducting surface 110, as described below in reference to FIGS. 4A and 4B.

Figure 1G:
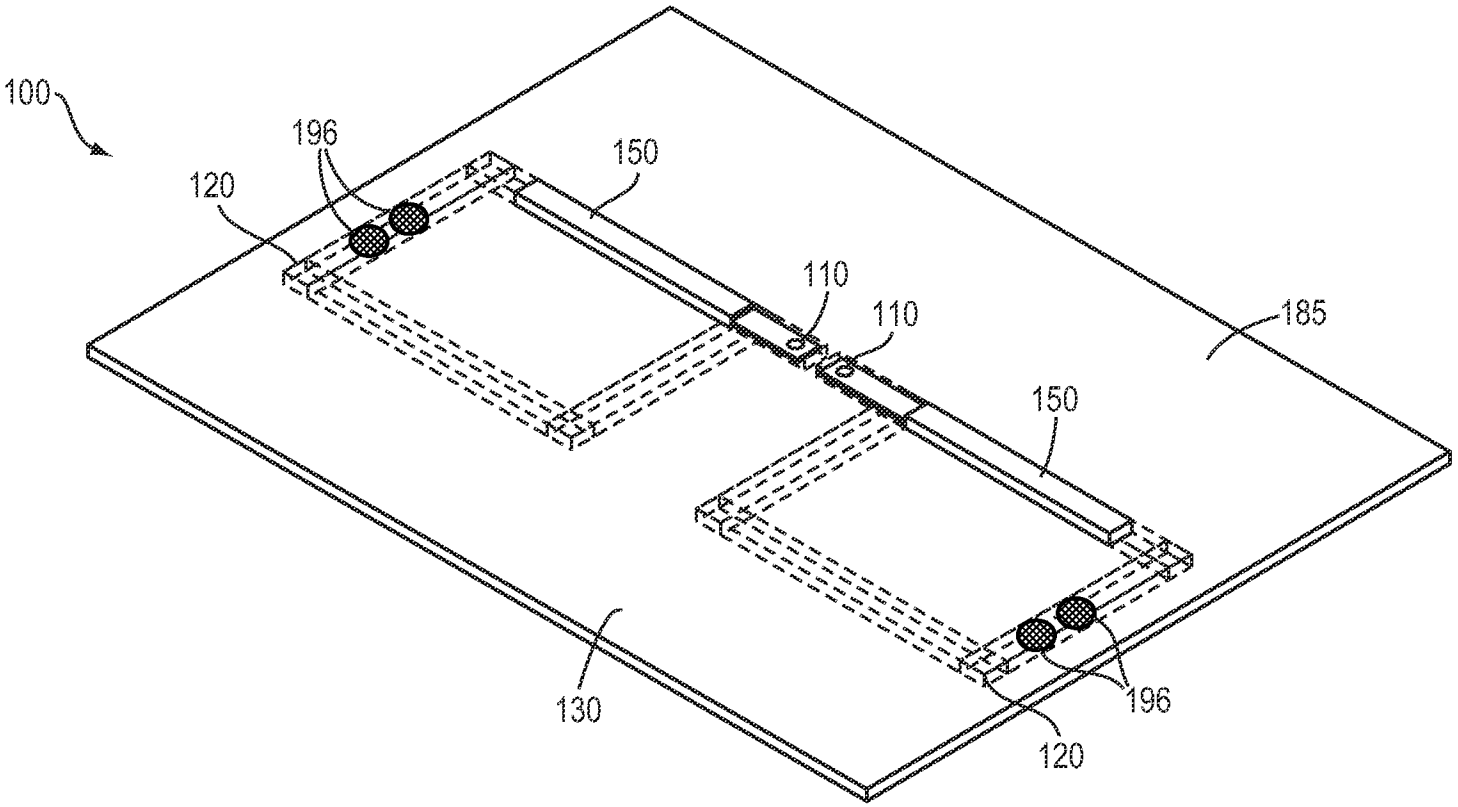
FIG. 1G schematically depicts a perspective view of another reconfigurable electronic component in accordance with various embodiments of the invention.

As shown in FIG. 1G, embodiments of the invention may utilize fluid or floating solid conductors to reconfigure electronic components such as dipole antennas. In FIG. 1G, component 100 (here a dipole antenna) includes a conducting surface 110 (in the form of two "arms") disposed on a layer 185. The frequency of component 100 may be tuned by positioning conductors 150 within microfluidic channels 120 to effectively increase the length of the antenna arms—component 100 may be tuned to the highest frequency when conductors 150 are fully disposed over conducting surface 110, and the tuned frequency may decrease as conductors 150 are extended outward therefrom. As shown in FIG. 1G, each conductor 150 may be disposed within a dedicated microfluidic channel 120, or a single microfluidic channel 120 may contain all of the conductors 150. As detailed above in relation to FIGS. 1A-1C, conductors may be repositioned within microfluidic channels 120 via an actuating mechanism 140 (not shown in FIG. 1G) disposed near an edge of layer 185 away from conducting surface 110. In other embodiments, microfluidic channels 120 may be connected to an actuating mechanism 140 (e.g., a pump) disposed therebelow via one or more fluidic ports 196.

Figure 2:
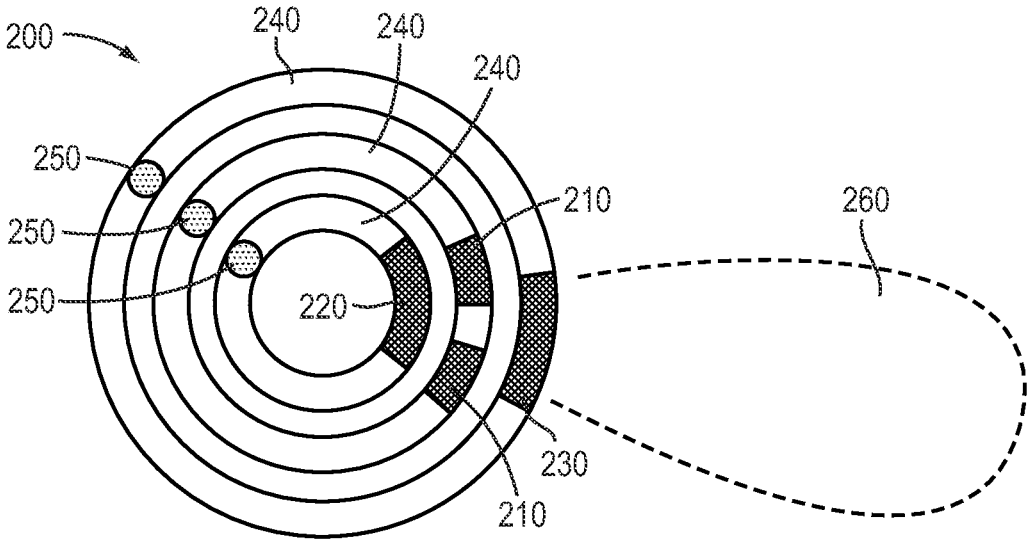
FIGS. 2 and 3 are schematic diagrams of steerable antennas in accordance with various embodiments of the invention.
Figure 3:
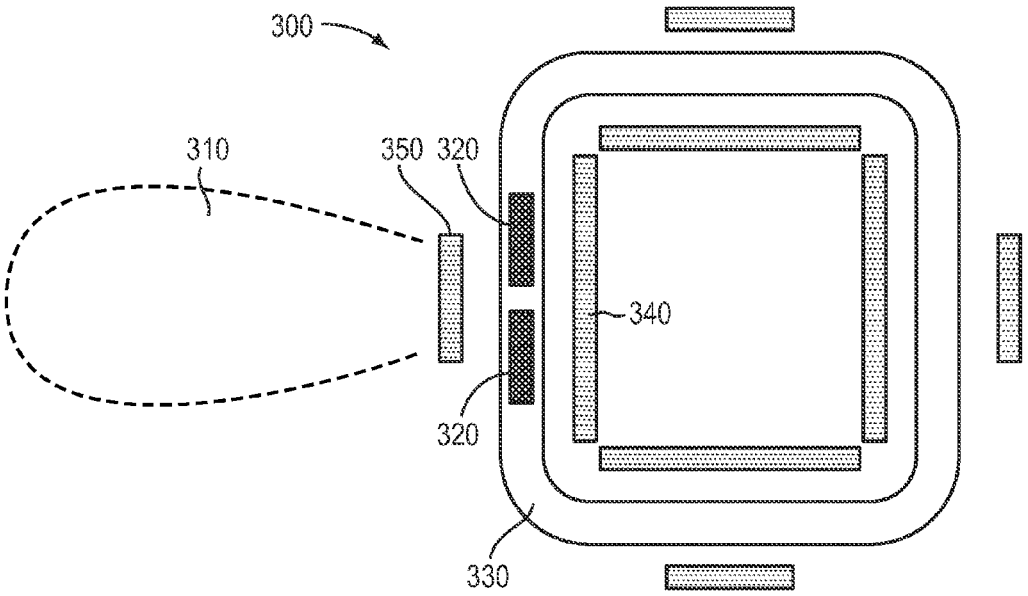

Referring now to FIGS. 2 and 3, fluidic and/or floating solid conductors may be used as part or all of a radiating structure for an electronic component such as an antenna, and the component may be reconfigured by moving the conductor. Such a scheme generally obviates the need for parasitic components (though they are optional, even in these embodiments), varactors, switches, and/or phase shifters utilized in other reconfigurable-antenna schemes. Instead, the reconfigurability of antenna shape and position are based on fluidic manipulation.

As shown in FIG. 2, in various embodiments, the present invention uses microfluidic technology to form a steerable miniature planar directional antenna 200, which may even be flexible since it is not formed solely of solid elements. Antenna 200 may be a Yagi antenna, which provides high gain in the forward direction and a very-small-amplitude back lobe. In a preferred embodiment, antenna 200 includes or consists essentially of a driven element 210 (e.g., a half-wavelength dipole element, depicted in two discrete portions, which is driven or connected to the receive chain), as well as two parasitic elements—a reflector 220 (which is typically slightly longer than the driven element 210), and a director 230 (which is typically slightly shorter than the driven element 210). The director 230 and reflector 220 generally enhance the radiation in the forward direction and provide high front-to-back ratio. Typically, polarization is predominantly linear in the plane of the antenna 200.

In various embodiments, driven element 210, reflector 220, and director 230 all include or consist essentially of fluidic conductors, or floated solid conductors, disposed in microfluidic channels 240. The conductors may be any of those described above in relation to FIGS. 1A-1C, and liquid or solid insulators may be utilized to substantially fill the remaining space in each of the microfluidic channels 240. Each microfluidic channel 240 may feature one or more fluidic ports 250 for connecting an actuating mechanism (not shown) thereto. As described above, the actuating mechanism may include or consist essentially of a pump or an actuating conductor movable by, e.g., electrowetting, among a plurality of electrodes. The actuating mechanism may be disposed out of the plane of the antenna 200, thus enabling steering of the antenna beam 260 (radiating from the driven element 210) in all directions.

As described above, microfluidic channels 240 may include or consist of one or more dielectric materials, e.g., polymers, glasses, and/or ceramics, and may (when the actuating mechanism is considered part of the channel) be closed and require no separate liquid reservoir.

As shown in FIG. 3, various embodiments of the invention utilize microfluidic technology to provide one or more elements of an antenna, but not all of them. Such embodiments may even advantageously utilize the above-described cover layer. As depicted, an antenna 300 emits a beam of radiation 310 that may be steered to any of four positions. The arrangement of FIG. 3 is exemplary only and presented for ease of depiction, as beam 310 may be steered among an arbitrary number of possible positions in accordance with embodiments of the invention. Antenna 300 includes or consists essentially of a driven element 320 that is a fluidic or floating solid conductor disposed within a microfluidic channel 330, as well as a reflector 340 and a director 350. The parasitic elements (i.e., reflector 340 and director 350) are typically formed of metal and may be printed directly on the substrate of antenna 300. Driven element 320 may then be moved within microfluidic channel 330 between the parasitic elements in order to steer beam 310 through any number of preset positions. Driven element 320 may be any of the conductors described in the above embodiments, and may be actuated with any one or more of the above-described actuating mechanisms coupled to microfluidic channel 330 via one or more fluidic ports (neither the actuating mechanism(s) nor the fluidic port(s) are shown in FIG. 3 for clarity).

During operation, the beam 310 is directed away from the center of rotation of antenna 300 so that, in any given position, the corresponding reflector 340 will shield the driven element 320 from the other parasitic structures on the substrate. The electrical feed (not shown) is typically connected to all possible positions (four are depicted in FIG. 3) in parallel. However, the line lengths are arranged to be half-wavelengths, so that they appear to be open circuits when not connected to the driven element 320. This configuration minimizes the amount of moveable conductor required, while still offering full rotation. As mentioned above, driven element 320 and microfluidic channel 330 may be disposed within an active cover layer 180 that may be temporarily or permanently affixed to the substrate of antenna 300.

In an embodiment, the design reconfigures the physical radiating structure in order to steer the antenna beam. Thus, parasitic elements are optional and (unlike in digital beamforming) a single radiating structure (i.e., the driven element 320) may be used. This is helpful in applications where small size is desired. The approach described herein enables large-scale, 360° motion for, e.g., X-band applications. This concept may also be applied to a steerable planar dipole, or even a wire antenna. It may also enable the reconfiguring of miniature antennas in response to environmental changes. Moreover, in various embodiments, the design offers immunity to multi-path effects, new scenarios in secure communications, low power adaptable radios for ad-hoc sensor networks, and jamming rejection. In addition to addressing power and bandwidth limitations for existing systems, embodiments of the invention may offer a fundamental new tool towards the vision of a cognitive radio. In various embodiments, these antennas enable the ability to sense and adapt to the surrounding signal frequencies, noise levels, and spatial profiles of electromagnetic transmissions.

Figure 4A:
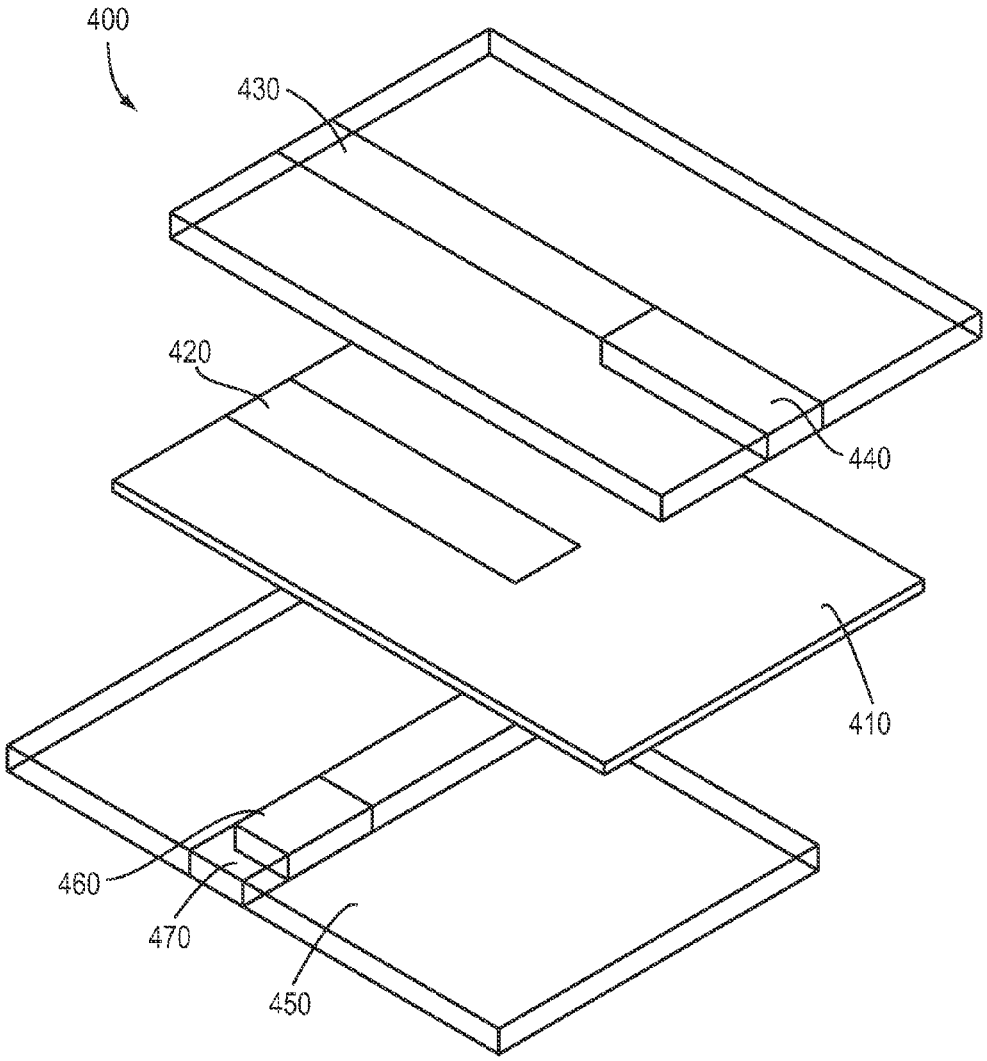
FIGS. 4A and 4B are exploded perspective views of reconfigurable electronic components utilizing floating solid conductors in accordance with various embodiments of the invention.
Figure 4B:
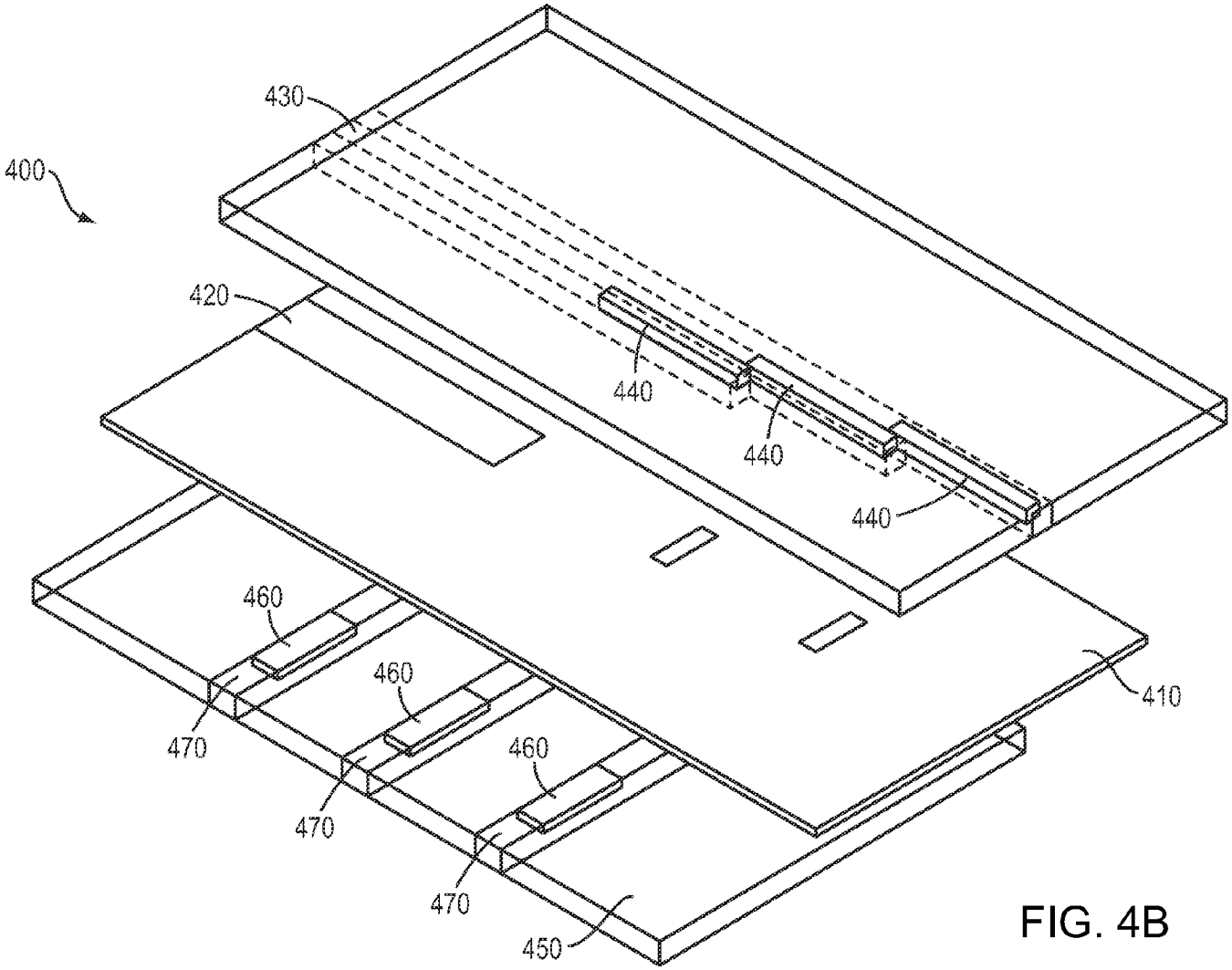

As mentioned above, the mobile conductors utilized in embodiments of the present invention to reconfigure various electronic components may be solid conductors floated in microfluidic channels. FIGS. 4A and 4B depict two such exemplary embodiments. As shown, an electronic component 400 includes a substrate layer 410 containing thereon (or therewithin) a conducting surface 420 forming, e.g., a portion of an antenna, a transmission line, a relay network, etc. Disposed thereover are one or more microfluidic channels 430, each of which may contain one or more solid conductors 440 floating in (and thus moveable within) a fluid (e.g., a dielectric fluid, not shown for clarity of presentation). The solid conductor(s) 440 are preferably magnetic and/or ferrous, and may be actuated within the microfluidic channels 430 via an actuating mechanism 450 disposed beneath the substrate layer 410. In an embodiment, the actuating mechanism 450 includes or consists essentially of one or more magnets 460 disposed within (and also floating within a fluid within) microfluidic channels 470 and moved therewithin via, e.g., a pump (not shown). When magnets 460 are moved to desired locations in microfluidic channels 470, the solid conductors 440 are attracted thereto and remain disposed substantially thereover, even in the absence of applied power. Thus, reconfiguration of component 400 may require little power to accomplish and little or no power to maintain a configuration once it is obtained, and reconfigurations may be performed at frequencies of approximately 1 to approximately 10 kHz.

In various embodiments, magnets 460 are not utilized to directly actuate solid conductors 440, but rather merely as "clamps" to hold solid conductors 440 in a desired position once they are actuated by actuating mechanism 450 (which may include or consist essentially of any of the actuating mechanisms described above). Magnets 460 may be fixed in desired positions, thus exerting a magnetic force on solid conductors 440 that is overcome, e.g., by a hydraulic force exerted upon solid conductors 440 by actuating mechanism 450, in order to reposition solid conductors 440. Or, as pictured in FIGS. 4A and 4B, magnets 460 may be themselves repositioned (e.g., by another actuating mechanism such as a pump) away from the path of solid conductor 440 along microfluidic channel 430 in order to remove the magnetic "clamping" force, thus facilitating repositioning of solid conductor 440. Once solid conductor 440 is moved to a desired position, magnets 460 may be moved back into position to "clamp" solid conductor 440.

Microfluidic channels 430, 470 may be closed, requiring no separate fluid reservoirs. During operation, solid conductors 440 may be wholly disposed directly over conducting surface 420, and thus have substantially no impact on the properties of component 400. If reconfiguration is desired, one or more solid conductors 440 may be extended outwardly from conducting surface 420, thus altering one or more of its electrical properties. As shown in FIG. 4A, the component 400 may include or consist essentially of a tunable monopole. As shown in FIG. 4B, the component 400 may include or consist essentially of a tunable dipole or Yagi antenna.

Figure 5:
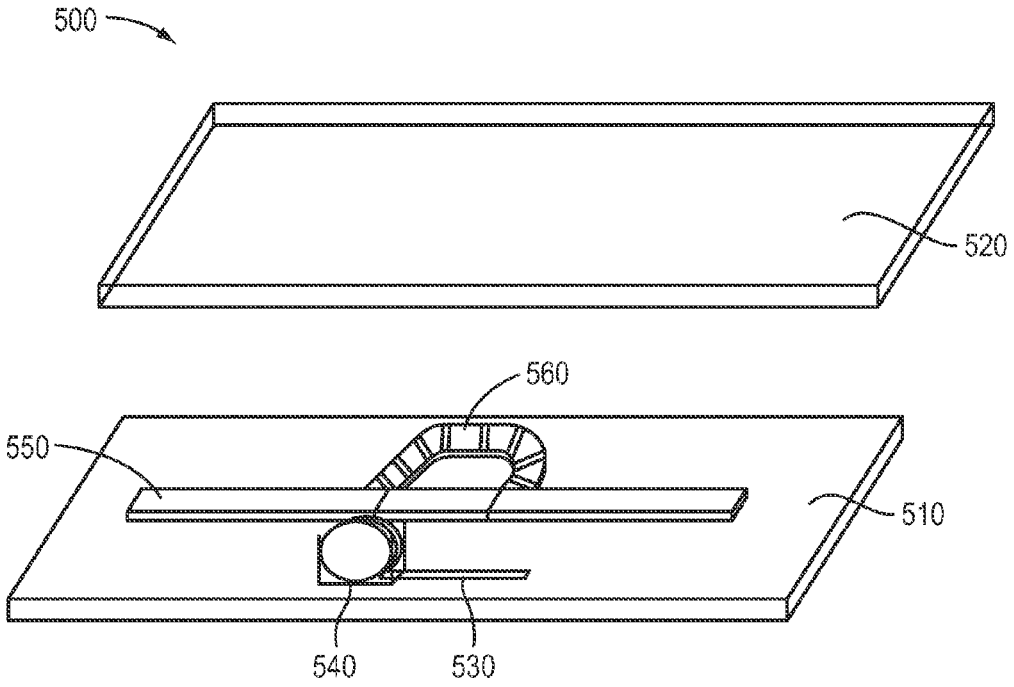
FIGS. 5 and 6 are exploded perspective views of reconfigurable electronic components utilizing conductive fluid bearings in accordance with various embodiments of the invention.

The functionality and design flexibility of the floating solid-conductor-based embodiments described above may be augmented via the use of fluidic interconnects. FIG. 5 depicts a reconfigurable electronic component 500 including or consisting essentially of a substrate layer 510 and a microfluidic layer 520. Component 500 includes a conductor 530 (e.g., an antenna feed) extending to and in electrical contact with a fluidic interconnect 540. Fluidic interconnect 540 may be any of the various conductive fluids described above in relation to FIGS. 1A-1C. Conductor 530 is electrically interconnected to a radiating structure 550 via fluidic interconnect 540. Fluidic interconnect 540 may be disposed within a recess in substrate layer 510. Radiating structure 550 (e.g., the dipole depicted in FIG. 5) is disposed within a cavity formed in microfluidic layer 520 that is substantially filled with fluid (e.g., a dielectric liquid) and within which radiating structure 550 may freely rotate and/or be repositioned. (Thus, while radiating structure 550 is shown separated from microfluidic layer 520 in FIG. 5 for ease of depiction, radiating structure 500 is generally disposed within microfluidic layer 520 in an assembled and operating component 500.) Radiating structure 550 may be moved within microfluidic layer 520 by any of the above-described actuating mechanisms. Since radiating structure 550 is electrically connected to conductor 530 via fluidic interconnect 540 (rather than a fixed solid interconnect), radiating structure 550 may be positioned or rotated arbitrarily without disrupting the electrical connection. An optional balun 560 may maintain the proper phase shift between arms of the radiating structure 550.

Figure 6:
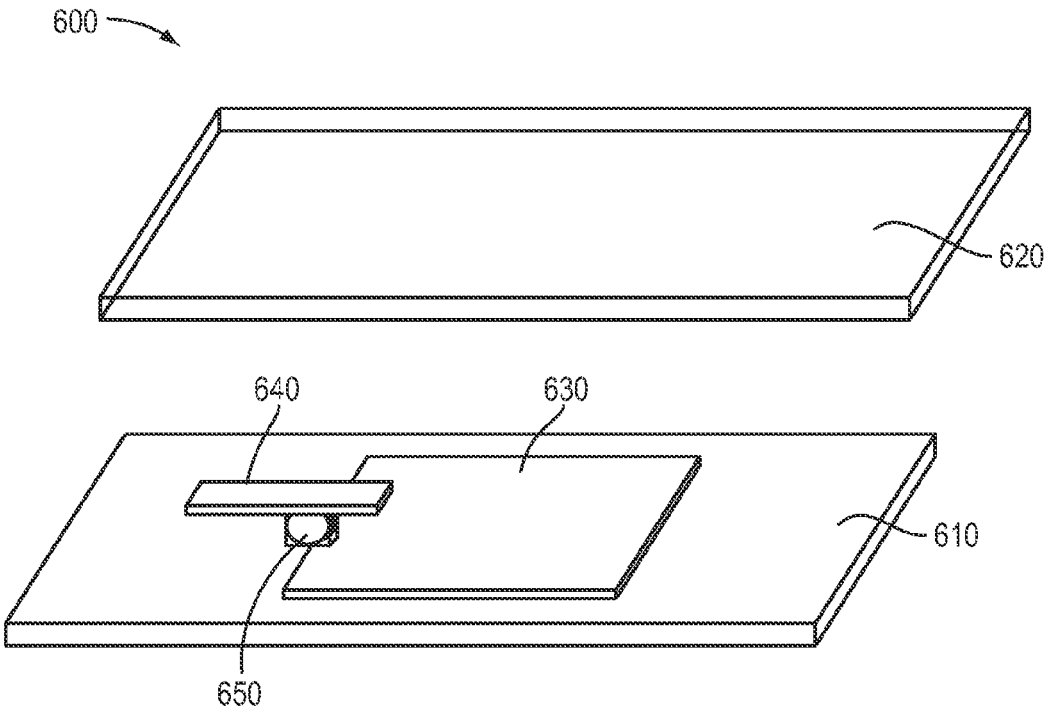

A similar concept may be utilized to tune the center frequency of electronic components such as patch antennas. FIG. 6 depicts such an electronic component 600, which includes or consists essentially of a substrate layer 610 and a microfluidic layer 620, similar to those described above in relation to FIG. 5. Component 600 includes a conducting surface 630 (e.g., a patch) and one or more solid conductors 640 disposed thereover and able to move relative thereto. Solid conductor 640 is generally floating within a recess formed within microfluidic layer 620, and is able to move such that it is substantially fully disposed over conducting surface 630 or extending an arbitrary distance therefrom (and, e.g., thus tuning a center frequency thereof, as described above in relation to FIGS. 1A-1C). Electrical contact between conducting surface 630 and solid conductor 640 is maintained by fluidic interconnect 650 in a manner like that described above in relation to FIG. 5. (As detailed above regarding FIG. 5, while solid conductor 640 is shown separated from microfluidic layer 620 in FIG. 6 for ease of depiction, solid conductor 640 is generally disposed within microfluidic layer 620 in an assembled and operating component 600.)

Microfluidic Baluns

The technologies herein described may also be utilized in the fabrication of baluns, which are typically utilized to convert a signal from a single-ended form, such as a signal in a microstrip or co-axial cable, to a balanced signal, such as that needed to feed a dipole. Baluns are usually designed to be wideband, rather than frequency tunable. However, losses in the balun may be problematic, depending on the specific design and targeted frequency range for the electronic component. More narrow-band baluns do often use quarter wave short-circuits, and sliding/adjustable short circuit bars can be adjusted by the user via screws when they are installed. Real-time frequency tunable baluns are typically achieved through the use of tunable capacitors. However, moveable feeds are not typically utilized for electronic components such as antennas.

In various embodiments, the invention provides a reconfigurable, adjustable, and/or moveable antenna feed structure for miniature systems. The structure may serve as a simple moving feed or also be configured as a moveable balun for a balanced antenna. Thus, frequency-tunable baluns may also be designed and fabricated. A reconfigurable balun enables one to adjust the impedance looking into an antenna, or to feed an antenna that is itself movable or reconfigurable. The general ability to reconfigure the size, shape, frequency, or position of a small antenna during operation enables new antenna designs that may be smaller, may serve lower power system designs, and may be tailored towards new applications.

Figure 7:
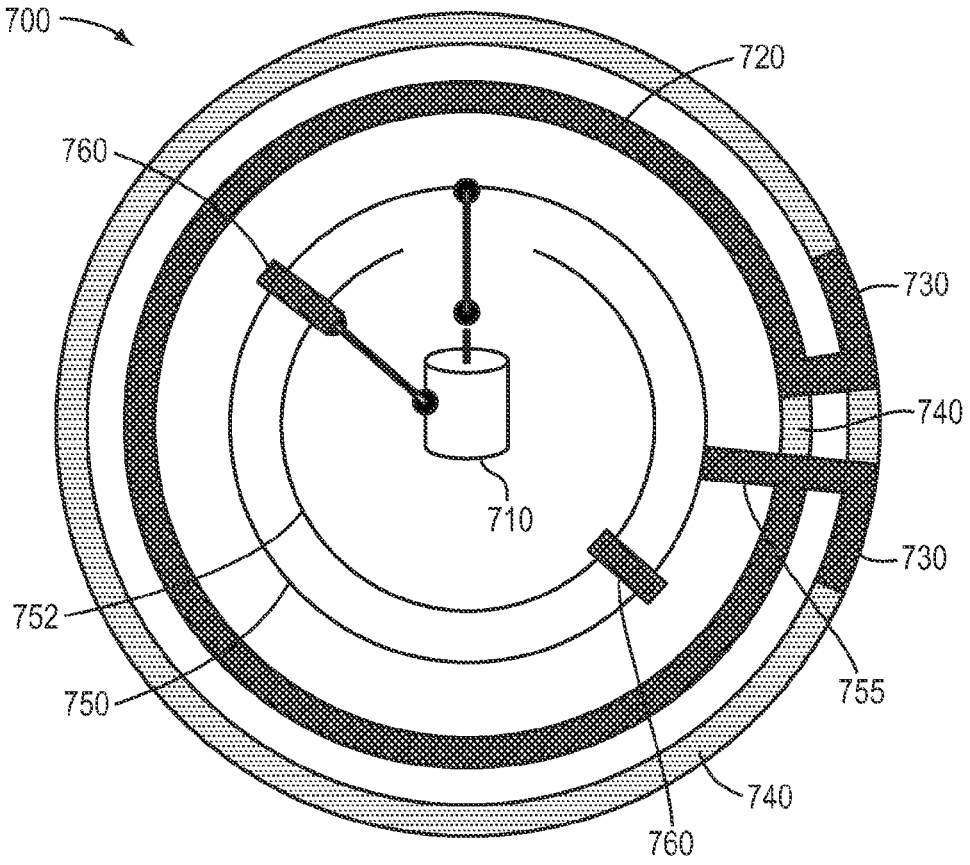
FIG. 7 is a schematic diagram of a moveable feed-and-balun structure enabling fabrication of moveable antennas in accordance with various embodiments of the invention.

Specifically, microfluidic technology may be utilized to move or reconfigure antenna feed structures. FIG. 7 depicts a portion of an electronic component 700 that includes a feed 710 and a fluidic balun 720. As pictured, component 700 is a portion of a planar antenna that is balanced and moveable. For example, the elements of component 700 may be utilized in component 200 depicted in FIG. 2. Balun 720 is shown feeding a dipole 730 (which may be fluidic, as described above) that moves in a circular pattern. Balun 720 and dipole 730 may include or consist essentially of a conductor, e.g., any of the fluidic or floating solid conductors described above in relation to FIGS. 1A-1C, and may be disposed within microfluidic channels 740. Microfluidic channels 740 may be closed, as detailed above, and may be substantially filled with the combination of the conductor(s) and fluidic or floating insulators (as detailed above). The feed 710, which may include or consist essentially of, e.g., a coaxial cable, is typically electrically connected to solid conducting wire 750 that is printed onto a planar substrate.

Feed 710 is electrically connected to wire 750 (which connects to balun 720 and dipole 730 in the illustrated example), and wire 752 (shown connected to the outer sheath of a coaxial cable feed 710) is grounded. Shorting stubs 760 connect the unused portion of the signal line 750 to ground at specific locations (here, at quarter-wavelength distances from the feed 710 and the connection to dipole 730). At least one stub 760 (e.g., the one closest to interconnect 755 in FIG. 7) generally rotates at this fixed distance when dipole 730 and balun 720 rotate (as detailed below). In some embodiments, the other stub 760 is substantially stationary and/or non-moveable. In some embodiments feed 710, printed wires 750, 752, and stubs 760 form a reconfigurable pick-off that may be utilized in conjunction with electronic components other than dipole 730.

In an embodiment, the center of feed 710 connects to one side of the dipole 730 via printed wire 750, and the connection between the printed wire 750 and the moveable dipole 730 is via a moveable interconnect 755 (which may be a fluidic or floated solid conductor disposed within a microfluidic channel, as described herein). From the connection point, balun 720 (here depicted as a $\lambda/2$ bypass balun) is formed within microfluidic channel 740. Balun 720 feeds the opposite side of the dipole 730 with a signal that is 180° out-of-phase with the first side.

In various embodiments, the entire balun-dipole structure may be rotated in unison while maintaining the proper phasing of the balanced feed as the dipole 730 is moved. The two stubs 760 may sit in different microfluidic channels (and may be, along with wires 750, 752 and/or feed 710, in a different plane than microfluidic channels 740), which are not shown in FIG. 7 for clarity. The feed 710 may be connected to a circular signal line so that a pick-off anywhere along the circle is enabled. Quarter wavelength shorts to ground may ensure that the "unused" printed wire 750 does not degrade the connection.

The exemplary structure depicted in FIG. 7 features several advantages. For example, because the balanced feed structure may be moved, fabrication of moveable antennas is enabled. In addition, because the shorting structures (i.e., stubs 760) may be moved, the balun 720 may be frequency tuned. In various embodiments, the balun design described herein enables ultra-small steerable and frequency tunable antennas. The balun design enables applications in sensor networks, steerable antennas, secure communications, anti jamming technology, and low power communications. These applications span the space of both commercial and military demands.

Example

The microfluidic technology described above may be incorporated into a GPS antenna in order to enable the tunability of its center frequency. Embodiments of this design also specifically address the need to maintain polarization and feed point impedance while tuning. An exemplary high-dielectric-constant GPS patch antenna has a one-inch square patch. For a tuning range of 20 MHz out of 1.575 GHz, the total area of the tuning "fingers" (e.g., portions of microfluidic channel 120 containing conductors 150 extending from an edge of the patch) may be approximately 0.013 square inch. This gets divided in half for fingers on each side, resulting in a finger area of 0.0065 square inches. In this example seven fingers are used on each side, each finger being approximately 0.0009 square inches in area. Preferably, the aspect ratio for a full length finger is typically three or four to one. Thus, at full extension, fingers approximately 15 mils wide are approximately 60 mils long.

In order to achieve circular polarization in a square patch, modes may be excited both vertically and horizontally by using a feed point along a diagonal of the conducting surface. The feed-point impedance is a function of the distance from the center of the patch to the feed location. Changing the finger lengths symmetrically typically adjusts the center frequency, but generally has only a second-order effect on the feed-point impedance. If the total length of the fingers is kept constant, but they are adjusted differentially from one side to the other, the effective location of the feed point will change, and the input impedance of the antenna may be thereby adjusted.

Tunable Inductors

Embodiments of the invention may also be utilized to implement tunable inductors that may themselves be utilized in applications such as miniature radios and/or be fabricated in a chip-scale format. Various embodiments may be utilized to form inductors of a wide variety of sizes and operational frequencies, e.g., for use in hand-held devices in which inductors are needed to perform in the range of 1 MHz to several GHz.

Figure 8:
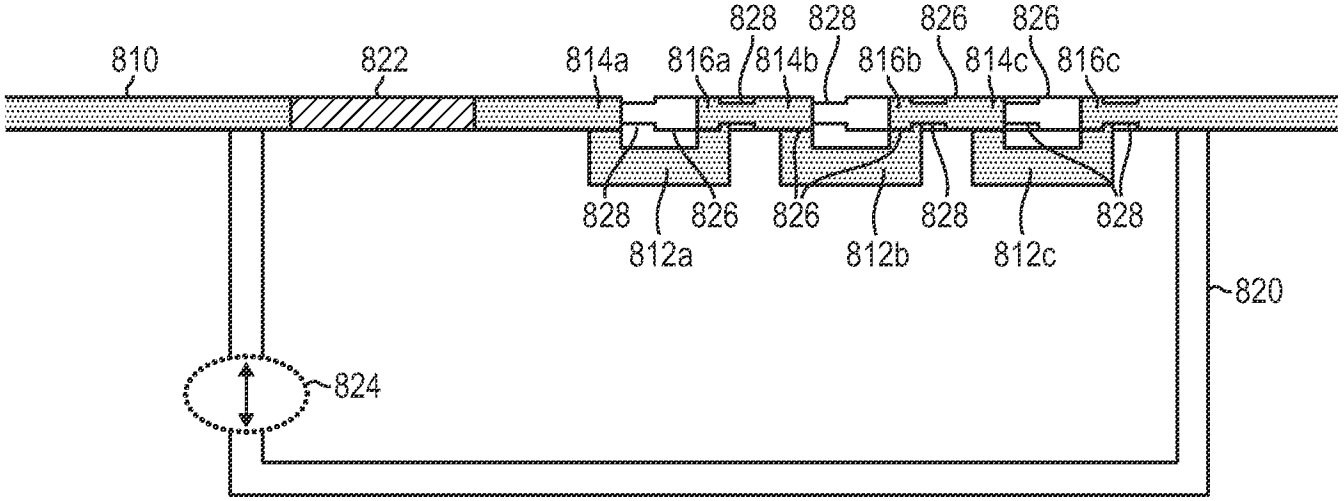
FIG. 8 schematically depicts a tunable inductor employing electrical shorting, in accordance with various embodiments of the invention.

An exemplary inductor 800 depicted in FIG. 8 includes a strip 810 having zig-zagged portions 812*a*, 812*b*, 812*c*. The zig-zagged portions 812*a*-812*c* form a coil of the inductor 800. The strip 810 and the zig-zagged portions 812*a*-812*c* typically include or consist essentially of a metal, and are generally substantially planar (much like the conducting surface 110 shown in FIGS. 1A-1C). The strip 810 and the zig-zagged portions 812*a*-812*c* may be disposed over a suitable substrate, such as the substrate layer 195 shown in FIG. 1C. The inductance of the inductor 800 depends, in part, on the size, shape, and number of the zig-zagged portions 812*a*-812*c*. Although the inductor 800 has three zig-zagged portions, it should be understood that this is illustrative only and that inductors having fewer or more zig-zagged portions are within the scope of the invention. Moreover, different zig-zagged portions 812*a*-812*c* may be configured to have different lengths and/or widths.

The inductor 800 also includes a microfluidic channel 820 and a conductor 822 disposed within the microfluidic channel 820. In addition to the conductor 822, a separate liquid is also disposed within the microfluidic channel 820. A part of the channel 820 overlaps the strip 810 and ends 814*a*, 816*a* of the zig-zagged portion 812*a*, ends 814*b*, 816*b* of the zig-zagged portion 812*b*, and ends 814*c*, 816*c* of the zig-zagged portion 812*c*. In some embodiments, however, the channel 820 may not overlap the ends of each zig-zagged portion of the strip 810. In the embodiment depicted, the conductor 822 is a liquid conductor as described above with reference to FIGS. 1A-1C, but it can instead be a solid conductor as also described above with reference to FIGS. 1A-1C. The inductor 800 also includes an actuator 824 for moving the conductor 822. As described above with reference to FIGS. 1A-1C and 4A-4B, the actuator mechanism 824 can include i) electrodes and an actuating conductor, ii) magnetic actuators, or iii) a pump.

When the conductor 822 is moved such that it overlaps the ends 814*a*, 816*a* of the zig-zagged portion 812*a*, the conductor 822 electrically shorts the zig-zagged portion 812*a*, thereby changing the inductance of the inductor 800. The movement of the conductor 822 can be controlled such that it overlaps one or more pairs of ends. For example, in another configuration, the conductor 822 may overlap each of the ends 814*a*, 816*a*, 814*b*, and 816*b*, thereby shorting the zig-zagged portion 812*b* in addition to shorting the zig-zagged portion 812*a*. By selecting the number of zig-zagged portions to be shorted, the inductance of the inductor 800 can be controlled. Additionally, or in the alternative, if different zig-zagged portions 812*a*-812*c* have different geometries (e.g., different widths, lengths, etc.), selecting the particular zig-zagged portions to be shorted, e.g., 812*a* and 812*b*, or 812*b* and 812*c*, etc., will control the inductance of the inductor 800.

FIG. 8 shows that relatively less-wide parts 828 of the microfluidic channel 820 divide the microfluidic channel 820 into larger-width parts 826. Such a configuration of the channel 820 is optional, and a channel having a substantially uniform width is also within the scope of the invention. In the embodiment depicted in FIG. 8, the conductor 822 is a fluidic conductor, such as liquid mercury, gallistan, another conductive alloy, or a conductive composite. The fluidic conductor 822, when pushed into one or more parts 826 overlapping the ends of one or more zig-zagged portions 812*a*-812*c*, stays within the parts 826 without substantially requiring any additional force. In other embodiments, the conductor 822 is a solid conductor, and may be clamped down, as described above with reference to FIGS. 4A-4B, with respect to the surface of the inductor 800 when the conductor 822 is disposed in a selected position.

In such a fashion, once the inductor 800 is configured to short one or more zig-zagged portions 812*a*-812*c*, virtually no additional power is needed to maintain that configuration of the inductor 800. In certain embodiments, the inductor 800 is appropriate for RF inductors operating in the GHz range. Typically, moving the fluidic conductor 822 or a solid conductor 822 can change the inductance of the inductor 800 on the order of nH per centimeter, depending on the detailed geometry. In various embodiments, the inductance of the inductor 800 can be changed from about 1 nH up to about 10 nH.

Figure 9A:
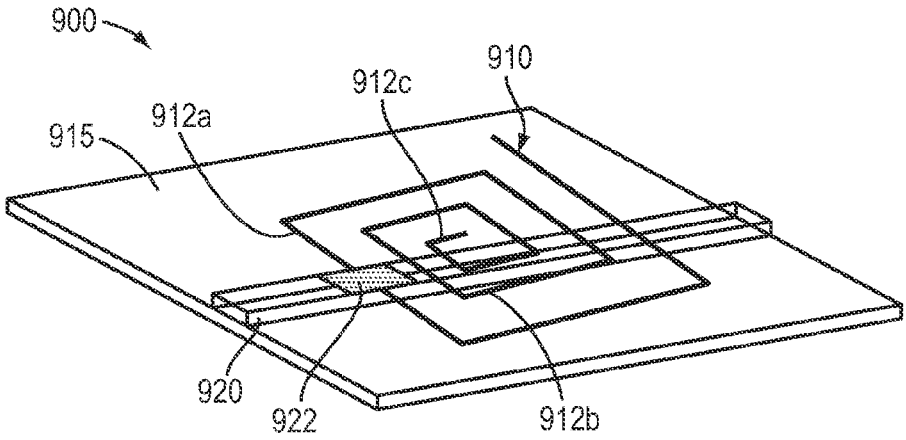
FIGS. 9A and 9B schematically depict tunable inductors in which a conductor can change a magnetic field associated with the inductor's conducting wire, in accordance with various embodiments of the invention.
Figure 9B:
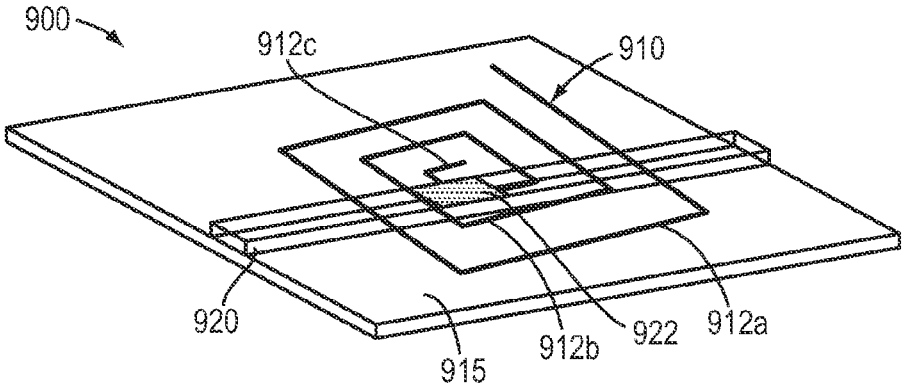

In another embodiment, depicted in FIGS. 9A and 9B, an inductor 900 includes a coil 910, i.e., a conducting wire, having spiral sections or windings 912*a*, 912*b*, 912*c*. The inductor 900 is disposed over a substrate 915. A microfluidic channel 920, which includes a magnetic material 922, is disposed over the coil 910. The magnetic material 922 can be moved over the different windings 912*a*, 912*b*, 912*c* of the coil 910 using any one of the actuator mechanisms described above with reference to FIGS. 1A-1C and 4A-4B. In FIG. 9A, the magnetic material 922 overlaps the winding 912*a*. In FIG. 9B, the magnetic material 922 overlaps the windings 912*b* and 912*c*.

It should be understood that coils including fewer or more than three windings are within the scope of the invention. Similarly, the length of the magnetic material 922, and/or the distance between two adjacent windings (e.g., the windings 912*a* and 912*b*, or the windings 912*b* and 912*c*, etc.), can be adjusted such that the magnetic material 922 overlaps only one winding at a time, or two or more windings at a time, when moved over such windings as described above. By selecting the number and the particular windings overlapped by the magnetic material 922, a magnetic field associated with the coil 910 can be changed, thereby causing the inductance of the inductor 900 to change.

Figure 10A:
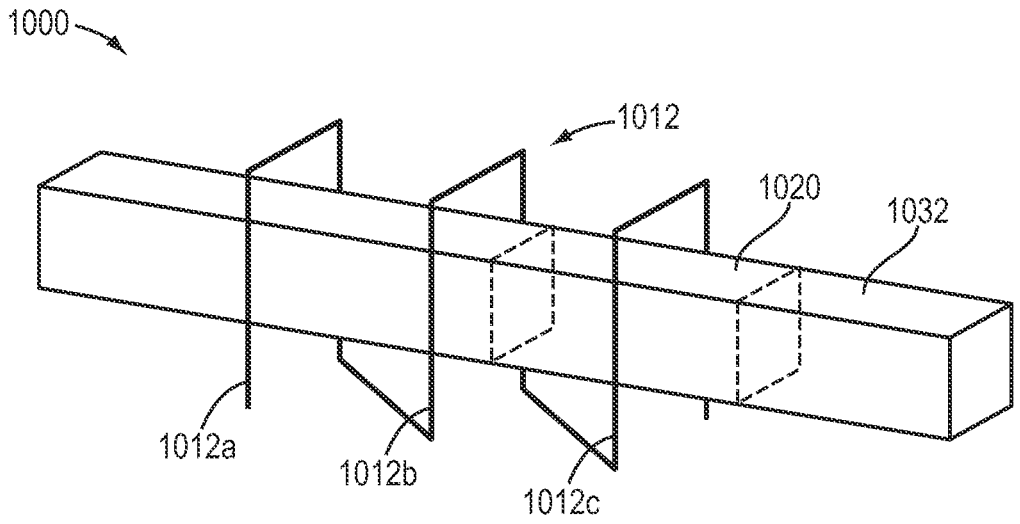
FIGS. 10A and 10B each schematically depict a three-dimensional tunable inductor in which a magnetic material can change a magnetic field associated with the inductor's conducting wire, in accordance with various embodiments of the invention.
Figure 10B:
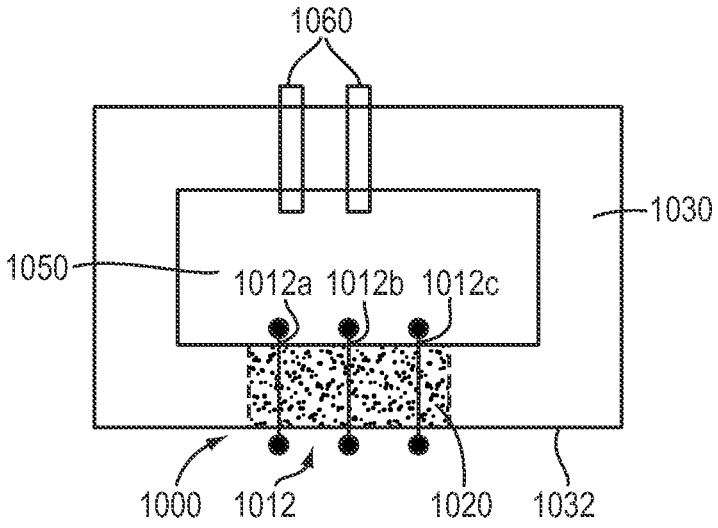

In another embodiment, with reference now to FIGS. 10A and 10B, a three-dimensional inductor 1000 is integrated with a PC board or multi-chip module (MCM). The inductor 1000 has three wire windings 1012*a*, 1012*b*, 1012*c* that together form a coil 1012, i.e., a conductive wire, of the inductor 1000. This is, however, only illustrative. Inductors having fewer or more wire windings are within the scope of the invention, and a typical three-dimensional inductor may have a coil that has tens or hundreds of wire windings. The wire windings 1012*a*-1012*c* may be formed using a MEMS-style process, where the vertical wires are made using silicon posts that are electroplated according to, e.g., the techniques described in U.S. Patent Application Publication Nos. 2009/0250823 and 2009/0250249. The disclosure of each of these two patent application publications is incorporated herein by reference in its entirety.

The inductor 1000 includes a bulk ferrite core 1020, which is magnetic. The magnetic core 1020 may also include or consist essentially of non-ferrous magnetic material, such as neodymium. A pick-and-place machine or manual placement may integrate the magnetic core 1020 with the pre-fabricated vertical posts, i.e., wire windings 1012*a*-1012*c* of the coil 1012. The overall shape of the inductor 1000 may be a square bar, as shown in FIGS. 10A and 10B, or the inductor 1000 may have other shapes or geometries, e.g., the inductor 1000 may be a toroid. The length of the inductor 1000 typically ranges from about 1 mm up to about 10 mm, resulting in typical inductance values ranging from approximately 1 nH up to approximately 10 nH. Inductors such as the inductor 1000 are suitable for, e.g., decoupling and power conversion.

In one embodiment, the bulk ferrite core 1020 is disposed within a microfluidic channel 1030. The channel 1030 may be formed using a tube 1032 that contains a working fluid. In some embodiments, instead of using the bulk ferrite core 1020, the tube 1032 is partially filled with segments of a high-permeability material (e.g., ferrofluids, magnetorheological fluids, or any solid, liquid, or composite material with significant magnetic permeability). The wire windings 1012*a*-1012*c* of the coil 1012 may be wrapped around the tube 1032.

Fluidic pumping or other actuator mechanisms (such as those described above with reference to FIGS. 1A-1C and 4A-4C) may be used to position the bulk ferrite core 1020 or the segments of the high-permeability (i.e., magnetic) material away from the coil 1012, partially inside the coil 1012 (i.e., overlapping one or more wire windings 1012*a*-1012*c* of the coil 1012), or completely inside the coil (i.e., overlapping all of the wire windings 1012*a*-1012*c* of the coil 1012). When the core 1020 or the high-permeability magnetic material is positioned away from the coil 1012, the inductor 1000 may function as an air-core inductor. In general, by changing a location of the bulk ferrite core 1020 with respect to the coil 1012 (or the amount of the high-permeability material in the tube 1032 that is located within the coil 1012), the inductance of the inductor 1000 can be varied.

In FIG. 10B, a fluidic chip 1050 is positioned in proximity to the glass tube 1032 (which can also be shaped as a toroid). The glass tube 1032 is filled with a combination of the bulk ferrite core 1020 (or a high-permeability material) and a working fluid. The working fluid may be pumped using electric fields applied from actuator electrodes 1060 disposed outside and remotely from the chip 1050. Because the actuator electrodes 1060 are not part of the chip 1050, the chip 1050 may be treated as any other electrical component for integration into, e.g., an MCM. The chip 1050 may be pick-and-placed in proximity to the coil 1012, and leads to the coil 1012 may be connected to circuitry within the chip 1050 as part of the final integration. The inductor 1000 that includes the coil 1012 and the bulk ferrite core 1020 (or the high-permeability material) can be tuned by repositioning the bulk ferrite core 1020 or the high-permeability magnetic material within the tube 1032, as described above. Thus, a tunable inductor is provided to the circuitry of the chip 1050.

Tunable inductors fabricated in accordance with embodiments of the invention may be utilized in, e.g., power conversion, isolation, RF matching networks, personal communications devices, GPS devices, personal computing devices, and miniature displays, as well as in other applications.

The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A reconfigurable inductor, comprising:

a conductive wire having a planar winding disposed on a planar surface of a substrate;

a channel configured to lie on the substrate over at least a portion of the conductive wire and contain a liquid, a portion of the channel extending from and not overlying the conductive wire;

a first conductor floating in the liquid that is disposed within the channel; and an actuating mechanism, which is distinct from the conductive wire, configured to displace the liquid, and thereby the first conductor, within the channel and in a direction that is parallel to the planar surface of the substrate to thereby alter an inductance of the reconfigurable inductor.

2. The inductor of claim 1, wherein the channel overlies only a part of the conductive wire.

3. The inductor of claim 1, wherein the channel is closed.

4. The inductor of claim 1, wherein the actuating mechanism comprises a second conductor disposed within a portion of the channel not disposed over the conductive wire.

5. The inductor of claim 4, wherein the actuating mechanism further comprises a plurality of electrodes for displacing the second conductor within the channel.

6. The inductor of claim 1, wherein (i) the first conductor is magnetic, and (ii) the actuating mechanism comprises a magnet disposed proximate at least a portion of the conductive wire.

7. The inductor of claim 1, wherein the first conductor electrically connects a plurality of portions of the conductive wire over which it is disposed.

8. The inductor of claim 1, further comprising an insulator disposed within the channel.

9. The inductor of claim 8, wherein the insulator is a fluidic insulator.

10. The inductor of claim 8, wherein the insulator and the first conductor are immiscible fluids.

11. The inductor of claim 1, wherein the channel and the actuating mechanism are disposed within a cover layer that is physically separable from the conductive wire.

12. The inductor of claim 1, wherein the first conductor is a conductive fluid.

13. The inductor of claim 1, wherein the first conductor comprises a conductive solid.

14. The inductor of claim 1, wherein displacing the first conductor in the channel changes an inductance of the inductor by a value ranging from 1 nH to 10 nH.

15. The inductor of claim 1, wherein the conductive wire is selected from the group consisting of a coil, a winding structure, a spiraling structure, and a zig-zagged structure.

16. A reconfigurable inductor, comprising:

a channel configured to (i) lie over at least a portion of a conductive wire having a winding and (ii) contain a magnetic material;

the conductive wire wound around at least a portion of the channel; and an actuating mechanism, which is distinct from the conductive wire, configured to displace the magnetic material within the channel to thereby alter an inductance of the reconfigurable inductor, the actuating mechanism comprising a conductor maintained within a portion of the channel around which the conductive wire is not wound.

17. The inductor of claim 16, wherein the channel is closed.

18. The inductor of claim 16, wherein the actuating mechanism further comprises a plurality of electrodes for displacing the conductor within the channel.

19. The inductor of claim 16, further comprising an insulator disposed within the channel.

20. The inductor of claim 19, wherein the insulator is a fluidic insulator.

21. The inductor of claim 19, wherein the insulator and the magnetic material are immiscible fluids.

22. The inductor of claim 16, wherein the magnetic material is a bulk ferrite core.

23. The inductor of claim 16, wherein the channel contains a fluid and the magnetic material comprises a high-permeability material floating in the fluid.

24. The inductor of claim 16, wherein displacing the magnetic material in the channel changes an inductance of the inductor by a value ranging from 1 nH to 10 nH.

25. A reconfigurable inductor, comprising:

a conductive wire having a planar winding disposed on a planar surface of a substrate;

a channel configured to lie along the substrate over at least a portion of the conductive wire and contain a magnetic material; and an actuating mechanism, which is distinct from the conductive wire, configured to displace the magnetic material within the channel and in a direction that is parallel to the planar surface of the substrate to thereby alter an inductance of the reconfigurable inductor.

* * * * *